US012291392B2

(12) United States Patent
Goodrich

(10) Patent No.: US 12,291,392 B2
(45) **Date of Patent: *May 6, 2025**

(54) SLIT PAPER METHOD OF EXPANSION, SHIPMENT AND EXPANSION DEVICES

(71) Applicant: HexcelPack, LLC, Sedona, AZ (US)

(72) Inventor: David Paul Goodrich, Sedona, AZ (US)

(73) Assignee: HexcelPack, LLC, Sedona, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/386,361

(22) Filed: Nov. 2, 2023

(65) Prior Publication Data

US 2024/0140688 A1 May 2, 2024

Related U.S. Application Data

(63) Continuation of application No. 18/093,087, filed on Jan. 4, 2023, which is a continuation of application (Continued)

(51) Int. Cl.
*B65D 85/672* (2006.01)
*B65B 61/04* (2006.01)

(Continued)

(52) U.S. Cl.
CPC ..... *B65D 85/672* (2013.01); *B65B 61/04* (2013.01); *B65D 5/02* (2013.01); *B65D 5/5004* (2013.01);

(Continued)

(58) Field of Classification Search
CPC ..... B65B 41/12; B65B 11/004; B65B 5/04; B65B 61/04; B65D 5/02; B65D 5/5004; B65D 5/04; B65D 85/672

(Continued)

(56) References Cited

U.S. PATENT DOCUMENTS 382,464 A 5/1888 Farr
847,977 A 3/1907 Ballard (Continued)

FOREIGN PATENT DOCUMENTS

CN 107921724 A 4/2018
GB 2069457 A 8/1981

(Continued)

OTHER PUBLICATIONS

An Office Action mailed by China National Intellectual Property Administration dated Jan. 6, 2022, which corresponds to Chinese Patent Application No. 201980043174.7; with English language translation (23 pages). Cited in Parent U.S. Appl. No. 18/093,087 on Apr. 4, 2023.

(Continued)

*Primary Examiner* — Anna K Kinsaul
*Assistant Examiner* — Mary C Hibbert-Copeland
(74) *Attorney, Agent, or Firm* — Studebaker Brackett PC

(57) ABSTRACT

An expansion devise includes an unexpended slit sheet roll that is wound on a paper core that is wider than the slit sheet paper. The paper core is placed into a yoke that holds the paper in position on each side of the unexpended slit sheet material. An adjustable downward pressure is exerted on the paper core and the paper core exerts pressure on the yoke. As the paper is pulled, this downward pressure creates the friction required to enable the unexpended slit sheet to be unwind and fed while simultaneously expanding. A blank sheet is formed into a box that stabilizes slit paper sheet wound around a core member.

24 Claims, 18 Drawing Sheets

Related U.S. Application Data

No. 15/428,144, filed on Feb. 8, 2017, now Pat. No. 11,608,222.

(60) Provisional application No. 62/435,037, filed on Dec. 15, 2016, provisional application No. 62/425,200, filed on Nov. 22, 2016, provisional application No. 62/292,727, filed on Feb. 8, 2016.

(51) Int. Cl.

| | |
|---|---|
| ***B65D 5/02*** | (2006.01) |
| ***B65D 5/50*** | (2006.01) |
| *B65B 5/04* | (2006.01) |
| *B65B 11/00* | (2006.01) |
| *B65B 41/12* | (2006.01) |

(52) U.S. Cl.
CPC ..... *B65B 5/04* (2013.01); *B65B 11/004* (2013.01); *B65B 41/12* (2013.01)

(58) Field of Classification Search
USPC ..... 53/410
See application file for complete search history.

(56) References Cited

U.S. PATENT DOCUMENTS

| | | | | |
|---|---|---|---|---|
| 1,270,279 | A | 6/1918 | Ferres | |
| 1,332,654 | A | 3/1920 | Webber | |
| 1,340,710 | A | 5/1920 | Anderson | |
| 1,364,259 | A | 1/1921 | Eaton | |
| 1,605,276 | A | 11/1926 | Peterson | |
| 1,640,760 | A | 8/1927 | Emery | |
| 1,733,834 | A | 10/1929 | Russell | |
| 1,875,153 | A | 8/1932 | Richter | |
| 1,888,549 | A | 11/1932 | Crafts | |
| 2,033,578 | A | 3/1936 | Kittel | |
| 2,213,764 | A | 9/1940 | Wolfgang | |
| 2,498,336 | A | 2/1950 | Kennedy | |
| 2,972,452 | A | 2/1961 | Peter | |
| 3,503,567 | A | 3/1970 | Casey | |
| 3,563,122 | A | 2/1971 | De Neui | |
| 3,602,452 | A | 8/1971 | Sauer | |
| 3,642,142 | A * | 2/1972 | Barnebl | B01D 33/056 210/401 |
| 3,734,424 | A | 5/1973 | Ulseth | |
| 3,738,588 | A | 6/1973 | Ayers | |
| 3,850,379 | A | 11/1974 | Stern | |
| 3,866,851 | A | 2/1975 | Brooks | |
| 4,002,238 | A | 1/1977 | Cameron | |
| 4,099,601 | A | 7/1978 | Pittman | |
| 4,116,749 | A | 9/1978 | Dufort | |
| 4,121,783 | A | 10/1978 | Wolfinger | |
| 4,190,211 | A | 2/1980 | Janzen | |
| 4,238,065 | A | 12/1980 | Ragsdale | |
| 4,336,911 | A | 6/1982 | Fairchild | |
| 4,411,393 | A | 10/1983 | Jodrey | |
| 4,477,037 | A | 10/1984 | Goldstein | |
| 4,625,931 | A | 12/1986 | Tamura | |
| 4,649,693 | A | 3/1987 | Yeager | |
| 4,679,745 | A | 7/1987 | Kim | |
| 4,706,442 | A | 11/1987 | Riemenschneider | |
| 4,715,519 | A | 12/1987 | Fischer | |
| 4,759,511 | A | 7/1988 | Kuhlmann | |
| 4,946,113 | A | 8/1990 | Riffle | |
| 4,998,656 | A | 3/1991 | Hurh | |
| 5,279,472 | A | 1/1994 | Hongo | |
| 5,322,201 | A | 6/1994 | Garr | |
| 5,538,778 | A | 7/1996 | Hurwitz et al. | |
| 5,564,645 | A | 10/1996 | Lissoni | |
| 5,630,563 | A | 5/1997 | Meisner | |
| 5,667,871 | A | 9/1997 | Goodrich et al. | |
| 5,688,578 | A | 11/1997 | Goodrich | |
| 5,725,175 | A | 3/1998 | Thundathil | |
| 5,755,397 | A | 5/1998 | Freese | |
| 5,782,735 | A | 7/1998 | Goodrich et al. | |
| 5,868,350 | A | 2/1999 | Christie | |
| 5,961,066 | A | 10/1999 | Hambleton | |
| 6,042,039 | A | 3/2000 | Furuya | |
| 6,102,322 | A | 8/2000 | Cordes | |
| 6,199,786 | B1 | 3/2001 | Lessard | |
| 6,244,530 | B1 | 6/2001 | Imai | |
| 6,564,942 | B1 | 5/2003 | Shiffler | |
| 6,871,480 | B1 | 3/2005 | Goodrich | |
| 6,929,213 | B1 | 8/2005 | Contreras | |
| 7,043,888 | B2 | 5/2006 | Gerulski | |
| 9,670,028 | B1 | 6/2017 | Pinto | |
| 9,701,091 | B2 | 7/2017 | Page | |
| 10,227,195 | B2 | 3/2019 | Page | |
| 11,220,395 | B2 | 1/2022 | Goodrich | |
| 11,504,937 | B2 | 11/2022 | Cheich | |
| 12,115,752 | B2 | 10/2024 | Goodrich | |
| 2001/0034998 | A1 | 11/2001 | Yamaai et al. | |
| 2002/0166917 | A1 | 11/2002 | Eagelman | |
| 2004/0084559 | A1 | 5/2004 | Fraser | |
| 2009/0081416 | A1 | 3/2009 | Goodrich | |
| 2009/0082187 | A1 | 3/2009 | Cheich | |
| 2009/0233023 | A1 | 9/2009 | Goodrich | |
| 2010/0054837 | A1 | 3/2010 | Sakai | |
| 2011/0309125 | A1 | 12/2011 | Kuchar | |
| 2013/0240657 | A1 * | 9/2013 | Kuchar | B65H 16/005 242/418 |
| 2014/0027553 | A1 | 1/2014 | Page et al. | |
| 2014/0208696 | A1 | 7/2014 | Phillips | |
| 2015/0122866 | A1 | 5/2015 | Kuchar | |
| 2015/0165717 | A1 | 6/2015 | Page et al. | |
| 2016/0067938 | A1 | 3/2016 | Goodrich | |
| 2016/0101960 | A1 | 4/2016 | Lam | |
| 2016/0130104 | A1 | 5/2016 | Page et al. | |
| 2016/0318320 | A1 | 11/2016 | Kokuta | |
| 2017/0203866 | A1 | 7/2017 | Goodrich | |
| 2017/0305173 | A1 | 10/2017 | Onodera | |
| 2018/0099834 | A1 | 4/2018 | Madrid | |
| 2018/0222665 | A1 | 8/2018 | Goodrich | |
| 2018/0236742 | A1 | 8/2018 | Cheich | |
| 2018/0281336 | A1 | 10/2018 | Cheich | |
| 2018/0370702 | A1 | 12/2018 | Goodrich | |
| 2019/0248092 | A1 | 8/2019 | Goodrich | |

FOREIGN PATENT DOCUMENTS

| | | | |
|---|---|---|---|
| WO | 2017039792 | A1 | 3/2017 |
| WO | 2017074535 | A1 | 5/2017 |

OTHER PUBLICATIONS

The extended European search report issued by the European Patent Office on Jan. 4, 2022, which corresponds to European Patent Application No. 19795837.4-1017 (9 pages). Cited in Parent U.S. Appl. No. 18/093,087 on Apr. 4, 2023.

First Examination Report issued in IN 202017047236; mailed by the Intellectual Property India dated Jun. 1, 2022. Cited in Parent U.S. Appl. No. 18/093,087 on Apr. 4, 2023.

The extended European search report issued by the European Patent Office on Nov. 18, 2021, which corresponds to European Patent Application No. 19919546.2-1017 and is related to U.S. Appl. No. 17/959,928.

An Office Action mailed by China National Intellectual Property Administration on Jan. 6, 2022, which corresponds to Chinese Patent Application No. 201980043174.7, with English language translation (23 pages).

The extended European search report issued by the European Patent Office on Jan. 4, 2022, which corresponds to European Patent Application No. 19795837.4-1017 (9 pages).

The First Examination Report issued in IN 202017047236, mailed by the Intellectual Property India on Jun. 1, 2022.

The International Search Report dated Aug. 20, 2020, issued in PCT/IB2019/001458 (2 pages).

International Preliminary Report on Patentability (Form PCT/IB/373) issued in International Application No. PCT/IB2019/001458 mailed Sep. 15, 2020 with Form PCT/ISA/237 and PCT/IB/326 (6 pages).

(56) References Cited

OTHER PUBLICATIONS

An Office Action dated Dec. 15, 2021, issued in IN Application No. 202017043805 (5 pages).
An Office Action issued by IP Australia on Jan. 24, 2024, which corresponds to Australian Patent Application No. 2019349561 and is related to U.S. Appl. No. 17/959,928.
Invalidity contentions filed in *HexcelPack, LLC* v. *Pregis LLC*, Case No. 23-cv-15282, Northern District of Illinois regarding U.S. Pat. No. 11,479,009 (Feb. 22, 2024), which case is now settled and closed with the '009 patent remaining in force.

* cited by examiner

SLIT PAPER METHOD OF EXPANSION, SHIPMENT AND EXPANSION DEVICES

CROSS-REFERENCE TO RELATED PATENT APPLICATIONS

This application claims the benefit of provisional patent applications 62/292,727, filed Feb. 8, 2016, 62/425,200, filed Nov. 22, 2016, and 62/435,037, filed Dec. 15, 2016, the disclosures of which are incorporated herein by reference, as though recited in full.

BACKGROUND OF THE INVENTION

Field of the Invention

This invention provides a simple method of expansion and shipment for expanded slit paper materials for wrapping and void fill for packaging items within a box for shipment, and an expander for expanding slit paper

Description of the Prior Art

The expanded slit paper prior art is disclosed in U.S. Pat. Nos. 5,538,778, 5,667,871, 5,688,578, and 5,782,735, are incorporated by reference in their entirety, and recited herein as if in full as part of the description of the present invention. The prior art consists of layering a slit in the form of the method of wrapping a combination of a tissue interleave sheet for the purpose of cushioning fragile items for shipment. The prior art also relates to a method of expanding the slit sheet material using an electrically powered apparatus.

SUMMARY OF THE INVENTION

A main object of the present invention is to overcome the shortcomings of the prior art.

The disclosures of patent application Ser. No. 14/480,319 filed Sep. 8, 2014 and Ser. No. 15/001,168 filed Jan. 19, 2016, are incorporated herein by reference, as though recited in full.

In accordance with a broad embodiment of the invention, the use of predominantly virgin paper for the manufacture of expanded slit paper provides a chaotic opening that eliminates the requirement for tissue paper between the expanded slit sheet layers.

In accordance with a broad embodiment of the invention, the use of a fold line within the flaps of a packing box is used for shipping the expanded slit paper to block and brace the paper core at each end while blocking and bracing the unexpanded slit sheet paper wound around the paper core that is narrower in width than the paper core. In accordance with a broad embodiment of the invention, an expansion device for slit sheet expanded materials utilizes pressure mechanism that is removable for easy paper loading for one and two layer systems.

In accordance with a broad embodiment of the invention, an improved unpowered manual expansion device provides a smoother expansion process and easier loading method.

In accordance with a broad embodiment of the invention, an expansion device for slit sheet expanded materials utilizes a pressure mechanism that is releasable for easy paper loading for one and two layer systems.

In accordance with a broad embodiment of the invention, the expansion device is made up of essentially two components. The first component is the unexpanded slit sheet roll that is wound on a paper core that is wider than the slit sheet paper. The paper core is placed into a yoke that holds the paper in position on each side of the unexpanded slit sheet material. The second component exerts an adjustable downward pressure on the paper core and the paper core exerts pressure on the yoke. As the paper is pulled, this downward pressure creates the exact, predetermined friction required to enable the unexpanded slit sheet to unwind and feed while simultaneously expanding.

In an embodiment of the invention, a blank sheet is provided for forming a box that stabilizes slit paper sheet-wound around a core member. The blank comprises four contiguous side panels that form four side walls of the box. The four contiguous panels having two end side panels and two interior side panels, and each of the four contiguous panels having a contiguous subpanel at each of two edges that are contiguous with a side panel. An attachment panel is contiguous with an end side panel and each of the subpanels have a first fold line between the subpanel and its contiguous side panel. Additionally, each of the subpanels has a second fold line proximate to its outer edge and each of the subpanels is separated from each adjacent subpanel. Each of the side panels is separated from a contiguous side panel by a fold line and each of the two interior side panels has a width between side panels with which it is contiguous. At least two of the subpanels have a distance between its first fold line and its second fold line that is less than one half of the width between side panels with which the at least two subpanels are not contiguous.

In an embodiment of the invention a box is formed from the blank sheet of the previous embodiment of the invention and contains a roll of slit sheet material wound around a core member. The core member has a length greater than the width of the roll of slit sheet material and forms protrusions that have a length that extends beyond the roll of slit sheet material by at least one fourth of an inch. Each of the subpanels have its second fold line folded inwardly toward an edge of the roll of slit sheet material, such that the distance between two adjacent second fold lines is about equal to the diameter of the core member, and the second fold lines abut against the core member protrusions.

In an embodiment of the invention the distance between each subpanel's second fold line and outer edge is substantially equal to the length of the protrusions and forms a subpanel region that is folded inward to press against the wound paper against the exterior of the paper core, thereby stabilizing the roll of slit material on the core member.

In an embodiment of the invention an expander device for expanding slit sheet material has:

- a first pair of side wall members;
- means for securing together the first pair of side wall members and maintaining the first pair side wall members a predetermined distance from each other;
- a roll of slit sheet material wound around a core member, the core member comprising one of a rod and a tube, and having a length greater than the width of the roll of slit sheet material and forming protrusions that have a length that extends beyond the roll of slit sheet material by at least one fourth of an inch, each of the first pair of side wall members have an arcuate opening for receiving a core member protrusion, the arcuate opening having a curvature that corresponds to the curvature of the core member; and
- first means for adjustably applying frictional pressure against at least one of the protrusions, whereby the force required to unwind the roll of slit sheet material on the core member is regulated.

In an embodiment of the invention an expander device for expanding slit sheet material includes a first pair of side wall members. Each of the first pair of side wall members have an arcuate opening for receiving a core member protrusion, the arcuate opening having a curvature that corresponds to the curvature of the core member the arcuate opening and has a radius curvature that is substantially equal to the radius of curvature of the core member.

In an embodiment of the invention an expander device for expanding slit sheet material, comprises first means for applying frictional pressure against at least one of the protrusions that includes an elongated arm hingedly connected at a first end to a first side wall member of the pair of side wall members. Second means is provided at its second end for pressing the hingedly connected member against a protrusion. The second means includes a threaded member that passes through the elongated arm and is treadedly connected to the first side wall member, the threaded member having an enlarged head and a spring member position around the threaded member between the enlarged head and the first side wall member. Rotation of the threaded member in a first direction compresses the spring member against the side wall member and increases the frictional pressure against a first of the protrusions and rotation of the threaded member in a second direction decreases the frictional pressure against the first of the protrusions.

In a further embodiment of the invention the foregoing first means for applying frictional pressure against the protrusions further comprises a second member hingedly connected at a first end to a second side wall member of the pair of side wall members and being an elongated arm and further having second means at its second end for pressing the hingedly connected member against a second of the protrusions.

In an embodiment of the invention, elongated arms have a region in contact with a protrusion, the region having radius curvature that is substantially equal to the radius of curvature of the core member.

In an embodiment of the invention, elongated arms have a region in contact with a protrusion, the region having radius curvature that is substantially equal to the radius of curvature of the core member.

In an embodiment of the invention, the means for applying frictional pressure against the protrusions further includes a piston member positioned to move at least one pressure member relative to at least one of the protrusions.

In an embodiment of the invention, the means for applying frictional pressure against the protrusions further comprising a pair of piston members, each piston member of the pair of piston members being positioned to move a pressure member away from a protrusion.

In an embodiment of the invention, an expander device includes an elongated arm member hingedly connected at a first end to a side wall member and having means at its second end for pressing the elongated arm member against a protrusion. The means is a threaded member that passes through the elongated arm and is treadedly connected to a side wall member. The threaded member has an enlarged head and a spring member position around the threaded member between the enlarged head and the side wall member, such that rotation of the threaded member in a first direction compresses the spring member against the side wall member and increases the frictional pressure against the protrusions and rotation of the threaded member in a second direction decreases the frictional pressure against the protrusions. Additionally, each member of the pair of piston members is positioned to move an elongated arm away from a protrusion, and means is provided for actuating each of the pair of piston members.

In another embodiment of the invention an expander has a first and a second pair of side wall members. Each member of the pair of side wall member is secure together for fixing the members of the pair of side wall members a predetermined distance from each other. The second pair of side wall members is mounted on the first pair of side wall members and a roll of slit sheet material wound around a second core member, is mounted on the second pair of side wall members.

In accordance with another embodiment of the invention a method of expanding slit sheet material is provided that comprises:

positioning a roll of slit sheet material wound around a core member on a first pair of side wall members;

the first pair of side wall members being secured together and maintaining a predetermined distance from each other;

the core member comprising one of a rod and a tube, and having a length greater than the width of the roll of slit sheet material and forming protrusions that have a length that extends beyond the roll of slit sheet material by at least one fourth of an inch;

each of the first pair of side wall members have an arcuate opening for receiving a core member protrusion, the arcuate opening having a curvature that corresponds to the curvature of the core member; and adjustably applying frictional pressure against at least one of the protrusions, whereby the force required to unwind the roll of slit sheet material on the core member is regulated.

In accordance with another embodiment of the invention a method of expanding slit sheet material is provided that comprises:

the step of applying frictional pressure against each of the protrusions pressing a member hingedly connected at a first end to a first side wall member of the pair of side wall members, by pressing a hingedly connected elongated member against a protrusion, the hingedly connected member being hingedly connected at a first end to a first side wall member of the pair of side wall members, and having means at its second end for pressing the hingedly connected member against a protrusion, and regulating the pressure applied against a protrusion by increasing or decreasing the pressure applied by the elongated member against a protrusion. The embodiment can further comprise the step of drawing and expanding slit sheet material from the roll of slit sheet material by applying a drawing force that is sufficient to overcome the frictional pressure applied against each of the protrusions. The embodiment can further comprise the step of wrapping multiple layers of expanded slit sheet material around an object, severing the multiple layers of expanded slit sheet material from the roll of slit sheet material, placing the wrapped object in a shipping container, such that the object is cushioned and protected by the multiple layers of expanded slit sheet material. The embodiment can further include the step of transporting the wrapped object in the shipping container from a first location to a second location.

In accordance with a broad embodiment of the invention, an expansion device for slit sheet expanded materials utilizes a pressure mechanism that is releasable for easy paper loading for systems employing one or two rolls of slit expandable sheets.

The prior art automatic expansion process of U.S. Pat. No. 5,538,778 requires the packer to be trained to wrap properly by keeping constant tension on the slit sheet material as it is fed automatically from the machine. It was difficult for the untrained packer to keep up with the exit speed of the expanded material and therefore maintain the proper tension. In accordance with an embodiment of the present invention tensioning is derived from the packer pulling the material which, automatic tensions and feeds the material, almost eliminating the training necessary to maintain the constant wrapping tension.

BRIEF DESCRIPTION OF DRAWINGS

The invention will be described with the accompanying drawings, in which.

DESCRIPTION OF THE EMBODIMENTS OF THE INVENTION

Definitions

Figure 1:
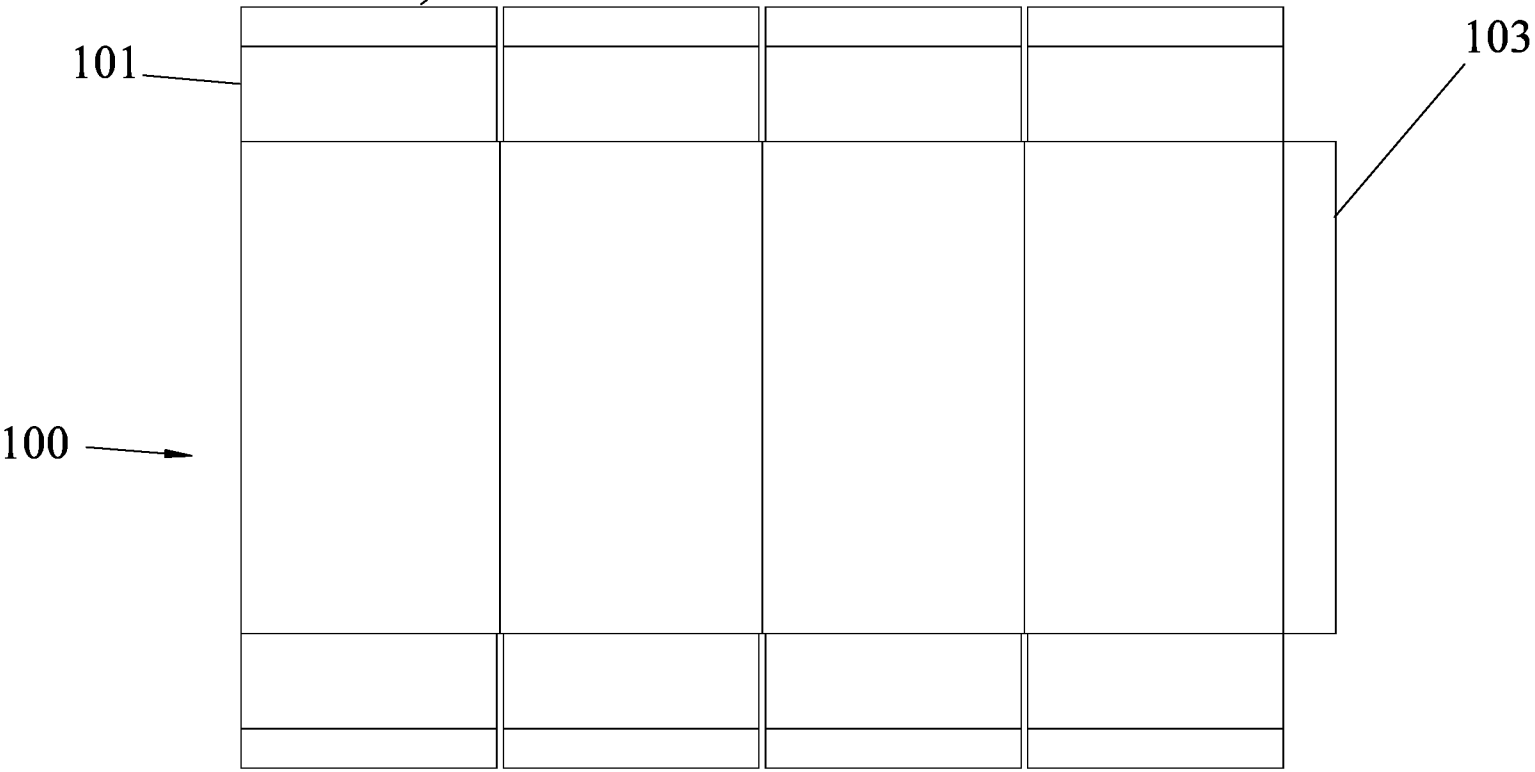
FIG. 1 is a line drawing of the corrugated box.

Where the definition of terms departs from the commonly used meaning of the term, applicant intends to utilize the definitions provided below, unless specifically indicated otherwise.

For the purposes of the present invention, the term "rotatable panel" describes the part of a corrugated box that rotates at a fold line creating a hinge that provides the top and bottom sides of a corrugated box that folds perpendicular to the sides of the corrugated box on which it is attached.

For the purposes of the present invention, the term "rotatable sub panel" is the part of the inner container that is part of the Rotatable Panel that further folds across a fold line creating a hinge that folds perpendicular to the plane of the Rotatable Panel.

For the purposes of the present invention, the term "sine wave" refers to a continuous wave across a thin material that creates hills and valleys.

For the purposes of the present invention, the term "telescope" describes a lateral movement of paper along the axis of the paper core.

For the purposes of the present invention, the term "parcel post" refers to the method of transportation that enables smaller type boxes to be shipped for a fee without the need for a pallet.

For the purposes of the present invention, the term "cross members" refers to the framework that separates and holds in position the yokes.

For the purposes of the present invention, the term "roll holder" is the fixture that provides the downward force to the paper core to modulate the friction required for expansion.

For the purposes of the present invention, the term "pressure arm" is the upper wood block that applies pressure to the paper core.

For the purposes of the present invention, the term "pressure arm assembly" refers to the parts associated with the pressure arm that encompasses the pressure arm, hinge, threaded wood insert, and threaded bolt.

For the purposes of the present invention, the term "wood slats" refer to the horizontal boards attached to the yokes to make up the manual expander.

For the purposes of the present invention, the term "threaded wood insert" relates to a threaded wood insert that has threads exteriorly to screw into a premade hole in the yoke with a threaded hole in its center to receive a steel threaded bolt.

For the purposes of the present invention, the term "threaded bolt" relates to a threaded machined screw that is used to hold the pressure arm downward at various pressures as required.

For the purposes of the present invention, the term "stretching-feeding process" refers to the action by which the expanded slit sheet material will feed as well as stretch.

For the purposes of the present invention, the term "single layer expander" refers to the entire system and all its parts associated with it that enables the stretching and feeding of the paper roll.

For the purposes of the present invention, the term "attached" refers to the method of securely fixing one part to another as one skilled in the art of assembling wood, wood composites, metal, or plastics in order to create a permanent assembly.

As defined in the prior art and referenced and recited as if in full prior application Ser. No. 14/480,319 is hereby referenced as part of the description of the present invention.

For the purposes of the present invention the descriptions of the paper and slit patterns within the embodiment of U.S. Pat. No. 5,667,871 can be used within this application.

Further information relating to the paper which can be used in the present invention, slit patterns, and the expansion process is found in U.S. Pat. Nos. 5,538,778, 5,667,871, 5,688,578, and 5,782,735, and application number 15001168 the disclosures of which are incorporated by reference herein, as though recited in full.

For the purposes of the present invention, the term "user" applies to the person using the expanding system for wrapping items.

For the purposes of the present invention, the term "wrapping" refers to the simultaneous stretching and feeding while wrapping an item to be packaged.

For the purposes of the present invention, the term "paper roll" refers to a roll of wound unexpanded slit sheet material wound around a core member that can be paper or an equivalent.

For the purposes of the present invention, the term "yoke" refers to the wood portion of the expander that holds the roll of unexpanded slit sheet material at each end of the paper core.

For the purposes of the present invention, the term "paper core" refers to the round paper tube that the expanded slit sheet paper is wound around.

For the purposes of the present invention, the term "releasable" refers to an upward pushing mechanism of the linear actuator as it releases the tension from the slit sheet unexpanded roll by separating the roll holder and the paper core.

For the purposes of the present invention, the term "linear actuator" refers to the electrical mechanism that upon actuation applies an upward force.

For the purposes of the present invention, the term "thumbscrew" refers to a typical screw that has an enlarged head for easier grip for turning by hand.

For the purposes of the present invention, the term "preset position" refers to the preset tension that is applied by the user to enable simultaneous stretch and feed of the expanded slit sheet material.

For the purposes of the present invention, the term "preset tension" refers to the same concept as preset position.

For the purposes of the present invention, the term "preset condition" also refers to the same concept as preset position.

For the purposes of the present invention, the term "the radius of curvature" is the reciprocal of the curvature. For a curve, it equals the radius of the circular arc which best approximates the curve at that point. For surfaces, the radius of curvature is the radius of a circle that best fits a normal section or combinations thereof.

For the purposes of the present invention, the term "power supply" refers to the device that converts the electrical power typically found in an electrical wall outlet to the proper voltage to operate the linear actuators.

DETAILED DESCRIPTION

Randomly, Irregularly Opening Expanded Slit Sheet Material

The new art provides a simpler solution for manufacturing slit sheet expanded material when a single expanded sheet is preferable to use versus the dual cross layered expanded sheets in pending patent application U.S. Ser. No. 14/480,319. The disclosures of U.S. patent application Ser. No. 14/480,319 and U.S. Pat. Nos. 5,538,778, 5,667,871, 5,688,578, and 5,782,735 are incorporated herein by reference in their entirety as if in full as part of the description of the present invention.

Whereas prior to the use of on or around 80% virgin fibers or more, the wedge effect or lack thereof was instrumental in the manufacture of uniformly opened or randomly opened cells. The new art, using Kraft paper having in the range of 80% or more virgin fibers, removes the requirement of altering the tooling so that the wedge would have little or no effect on the paper. Presently, and explained in the prior patent applications incorporated herein by reference, a wedge effect places an emphasis in cell opening direction by which one skilled within the art can orient the tooling to continuously open the cells either forward or backward dependent upon the wedge orientation of forward or rearward of the direction of the manufacturing process. Now, the same tooling, oriented to produce uniformly opening cells in recycled paper can be used for producing randomly, irregularly opening cells with virgin paper without having to alter the tooling. This saves time, labor, and tooling costs that previously required separate tooling for each type required.

The term "random" as employed herein with regard to the opening of cells, means that at least 20% of the cell undergo switch backs. Preferably, no more than 15% of the adjacent cells have uniform angles of inclination.

For the purposes of the present invention, the term "switch back" means the reversal of the angle of the inclination of the land at some point or points along the length of the sheet of expanded slit sheet material. A reversal of the angle of inclination constitutes a switch back. By way of example, a reversal of the angle of inclination from an inclination of about +60 to about −60 degrees (60 to 120 degrees) constitutes a switch back. Switch back can occur due to extraneous forces other than the wedge effect which causes rows of cells that to reverse themselves, as disclosed in U.S. Ser. No. 14/480,319. In this instance, the creation of chaotic cells is a function of the randomly accumulated long curly fibers that make up a paper sheet creating switch backs, not in rows or in clumps, but at a cell to cell level.

For the purposes of the present invention, the term "nesting" means the grouping of cells into one another such that an upper slit sheet material cell can fit within the lower slit sheet material cell to the point at which the thickness gain is not substantial. Preferably, the nesting produces a loss of thickness of two adjacent layers of not great than about 15%, and most preferably, the nesting produces a loss of thickness of two adjacent layers of not great than about 10%.

For the purposes of the present invention, the term "hinged" means a jointed device or flexible piece to which a pressure applying member is attached that enables the member to turn, swing, rotate, or move in relation to another fixed member.

Virgin paper has fibers that are long but not straight. During the paper manufacturing process the fibers curl and twist in a variety of fashions as they fall on the screen that enable the fibers to be processed during the paper making process. The screen enables the water to be used as the vehicle for driving the fibers to the screen. The screen is moving in the direction of the manufacturing process and thus creates a continuous sheet of paper that travels past the filtering process to the drying and flattening process. The fibers dry in a tangled web of multiple and interweaving layers. As the fibers dry the memory of their original shape returns. This memory is static such that, if it is a continuous sheet, the layers of randomly layered fibers keep the sheet flat.

When recycled paper is produced, dust is created. This dust is as a result of pulverizing the fibers. These fibers are very short and are easily removed by the die cutting process. Conversely, the long fibers of the virgin paper, being long and resilient, are cut and not pulverized. This creates a lengthening of the paper that can only be accounted for by accumulation creating a sine wave. This fiber memory creates an undulating or sine wave effect on the paper of about 0.03-0.06" from the top of the sine to the bottom running transversely to the direction of manufacture or in the direction of the slits within the paper, and a smaller sine wave exists every one-quarter inch in the direction of manufacture. The top of the sine wave in every other slit row is in a repeating pattern.

These rows of sine waves easily overcome the subtle impression that the wedge effect applies to the paper and subsequently the expansion process is far from uniform as each sine wave turns the paper forward or backward in an even greater chaotic pattern then when using a center bevel tool that provides no wedge effect.

Prior teachings of making expanded slit paper express a need for the sheet to be flat in order to produce tightly wound rolls. The paper in this instance does not wind up as tightly but, the increased random opening of the cells more than overcomes this shortfall by providing a non-nesting layering that creates a larger diameter roll than the two-layer interlocking system of the prior art.

Box for Unexpanded Slit Sheet Material on a Roll

Packaging the roll of expanded slit sheet material is unlike any system required to ship a wound roll of material Parcel Post. The preferred shipment method is to place the roll in a box exactly sized to optimally fill the space within and ship. The new art requires additional protection for the paper core that extends, in this instance approximately one and half inches for each side of the paper. The paper core can be easily damaged and the wound unexpanded slit sheet material can telescope easily if the box were to ship in its vertical position or dropped.

The new art solves this problem without any added cost to the packaging by adding a score line to the box flaps that creates a rotatable subpanel that can be folded inward to press against the wound paper and press against the exterior of the protruding paper core. This design is easily done without tooling by the manufacturer of corrugated boxes and without additional cost.

Manual Expander Design

The new manual expander art provides the same service as the prior art of provisional patent 62/292,727. The disclosures of U.S. Patent 62/292,727 is incorporated herein by reference in its entirety as if it were recited in full as part of the description of the present invention. The new art provides several improvements to simplify use, shipment, and assembly.

Figure 7:
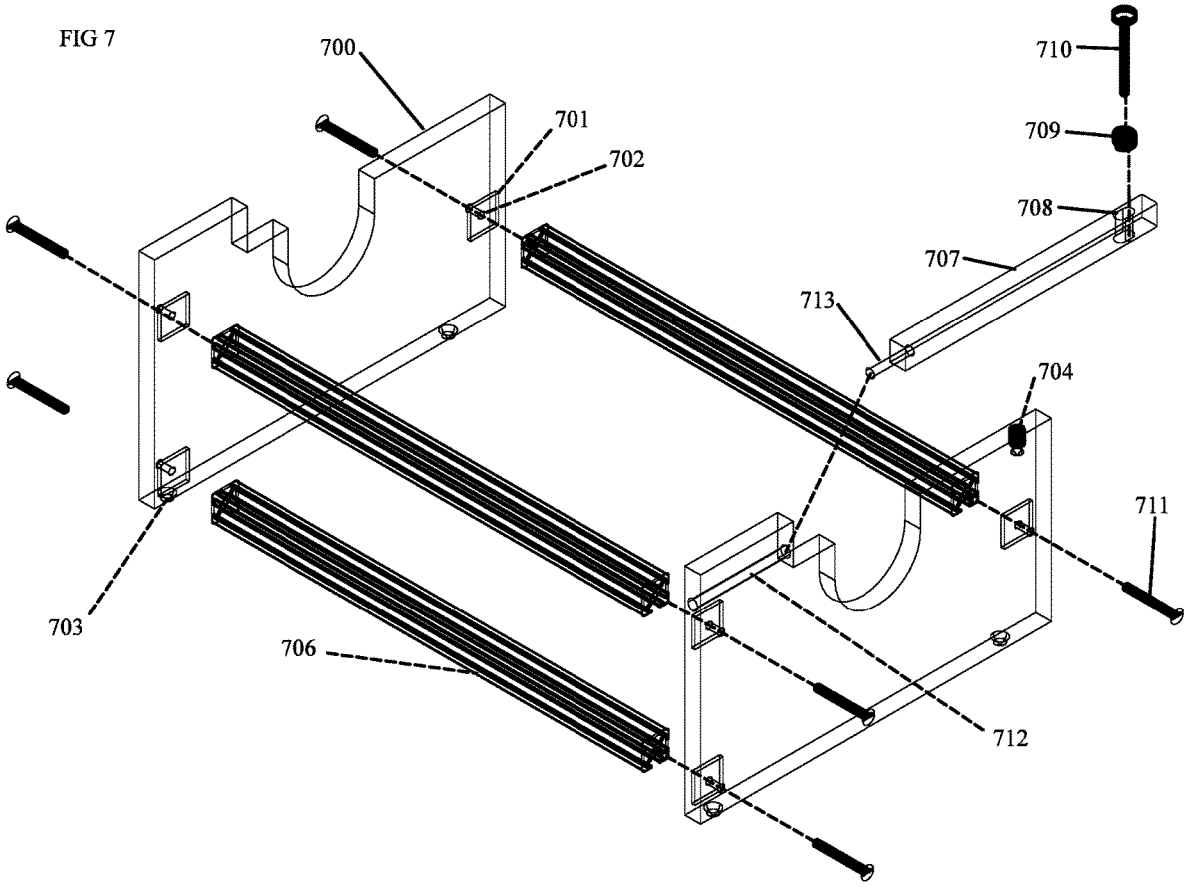
FIG. 7 is a perspective view of the single layer expansion system unassembled exploded view.

The first improvement enables the expander to be shipped unassembled saving significant Parcel Post freight costs. This is done by using six screws and extruded aluminum cross members connected to the yokes with a screwdriver as can be seen in FIG. 7. The prior box for the single expander was 21"×10"×8" and has been reduced to 16"×10"×3" and a reduction in weight from 8 to 4 pounds. The prior double expander shipped in a box size of 24"×12"×28" and has been reduced to 22"×14"×4" with a reduction of weight from 28 to 8 pounds.

The second improvement is with the use of a thinner wood material for the yokes. These are held apart by the cross members. The thinner wood reduces the friction against the paper core and provides an easier expansion with less ripping. The minimum thickness for the wooden yokes is ¼" with a preferred thickness in the range from ½" to ⅝" with a maximum thickness of 2".

Figure 14:
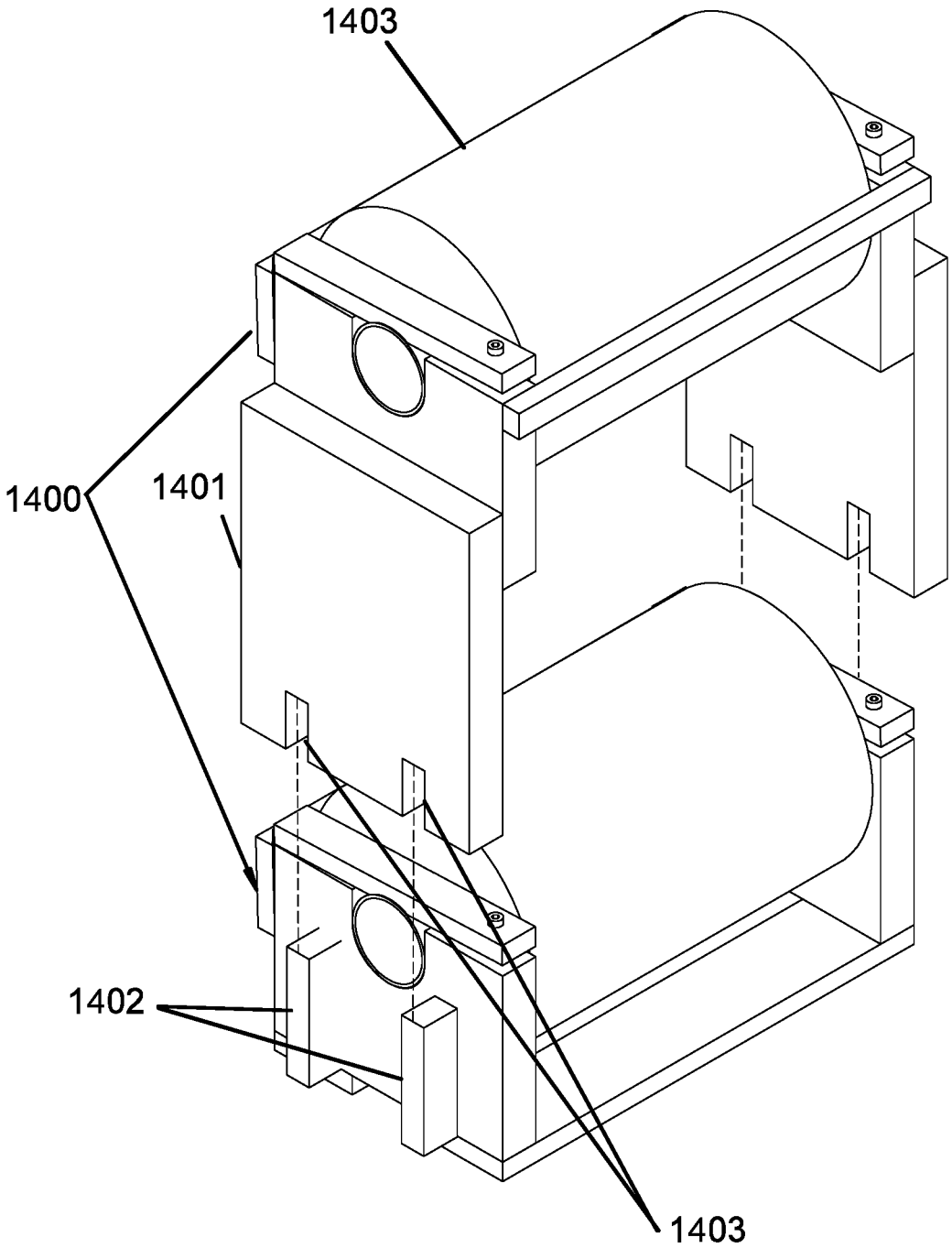
FIG. 14 is an exploded perspective view of the double layer system.
Figure 16:
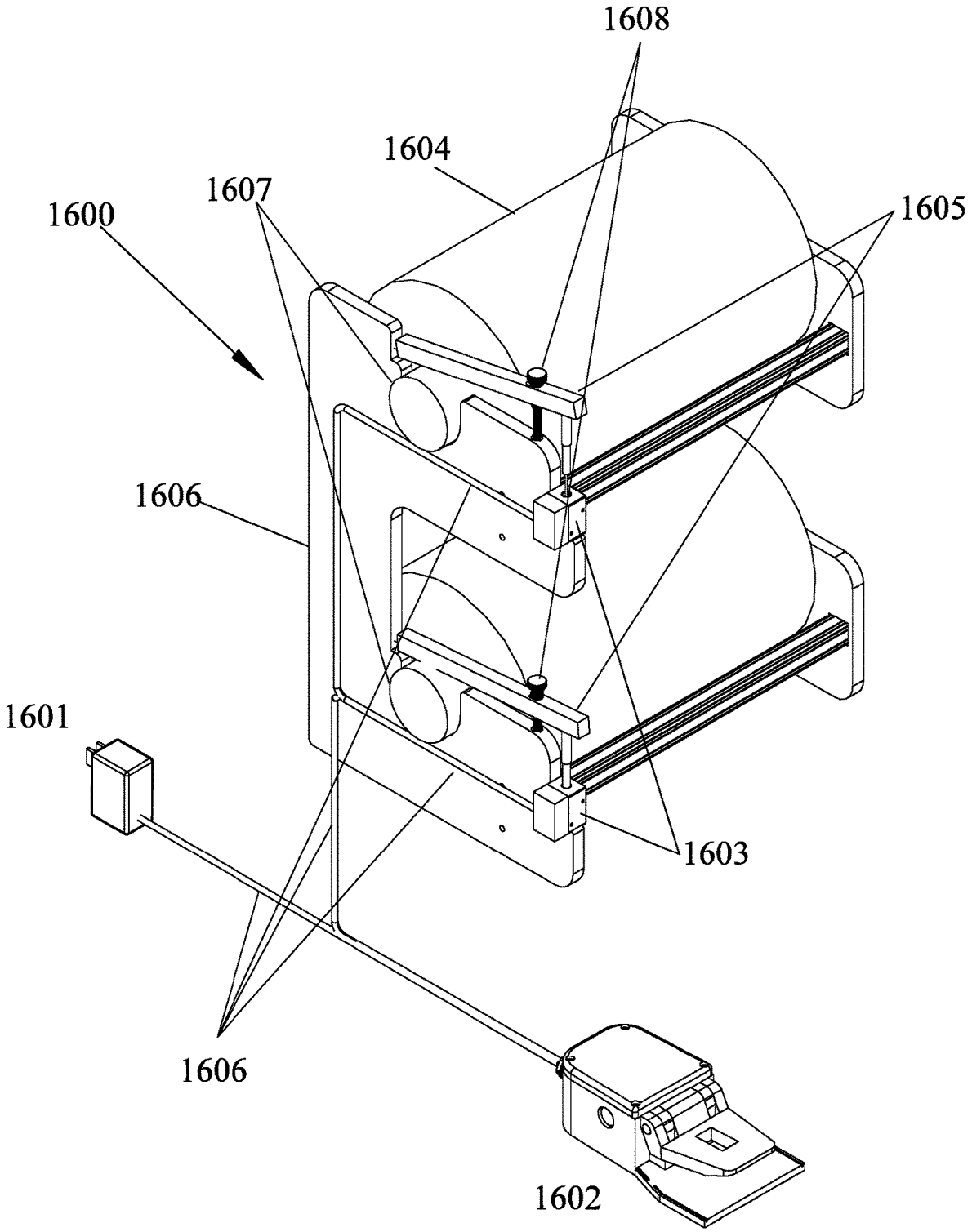
FIG. 16 is a perspective view of the double layer slit sheet expanding system.

The third improvement is the use of a removable roll holder. This enables the double layer expander to be constructed with one fixed double yoke, as shown in FIG. 16, versus a removable upper yoke, as shown in FIG. 14. This greatly reduces the labor of paper roll refilling by eliminating the requirement of removing the upper yoke by lifting it off and placing it aside and then reattaching after the paper roll has been placed in the lower yoke. The new system, shown in FIG. 8, requires only the removal of the roll holder, as shown, to guide the paper quickly onto the bottom yoke, as shown. The roll holder is then reconnected to the yoke at the back end with a dowel that fits into a guiding hole and is attached by the thumb screw to the yoke into the threaded wood insert.

Description of the First Embodiment of the Manual Expander Invention

The paper roll is made up of the paper core with the wound unexpanded slit sheet paper. The paper core is wider than the unexpanded slit sheet paper enabling it to protrude on both sides. The minimum paper core protrusion is ¼" beyond each end of the paper roll and ½" is preferred to allow for some side-to-side movement. The optimal paper core width is 1½" for ease of loading with anything over 2" being of no further help to paper roll loading.

The single layer expander is first comprised of two wooden yokes, preferably made of wood, that make up the right and left sides of the wood expander to keep the paper roll suspended and able to rotate. The yokes receive the ends of the paper core of the paper roll. The top portion of the yokes are cut down at the top to keep the paper core exposed so that the pressure arm can apply pressure directly to the yoke. The yokes are connected using wood slats or the like to create a box shape that is open on the top to receive the paper and open in the front bottom to feed the paper. The single layer expander loads the paper roll by rotating the pressure arms upward at the rear hinge, and then closing the pressure arms on the paper core and screwing the threaded bolt downward into the threaded wood insert located at the opposing end of the pressure arm hinge. Once the paper is in place, the pressure arm is down and the threaded bolt is engaged to the threaded wood insert, then the threaded bolt can be adjusted to enable the stretching-feeding process by turning the bolt to the precise point at which the slit sheet material stretches while continuing to unwind the paper such that a continuous stretching-feeding process is created to wrap an item.

The paper roll is specifically oriented within the box to feed the paper from the top or the bottom of the roll but preferably the bottom.

The present design, shown in FIGS. 6,7,10,12, and 13, represent a single roll and therefore a single layer of any type of expanded slit sheet material exiting the expander. The preferred embodiment is to use the non-uniform expanded slit sheet material described in patent pending application Ser. No. 15/001,168. FIGS. 14-18 represent the use of the two layer interlocking system described in patent pending application Ser. No. 14/48,0319.

Figure 15:
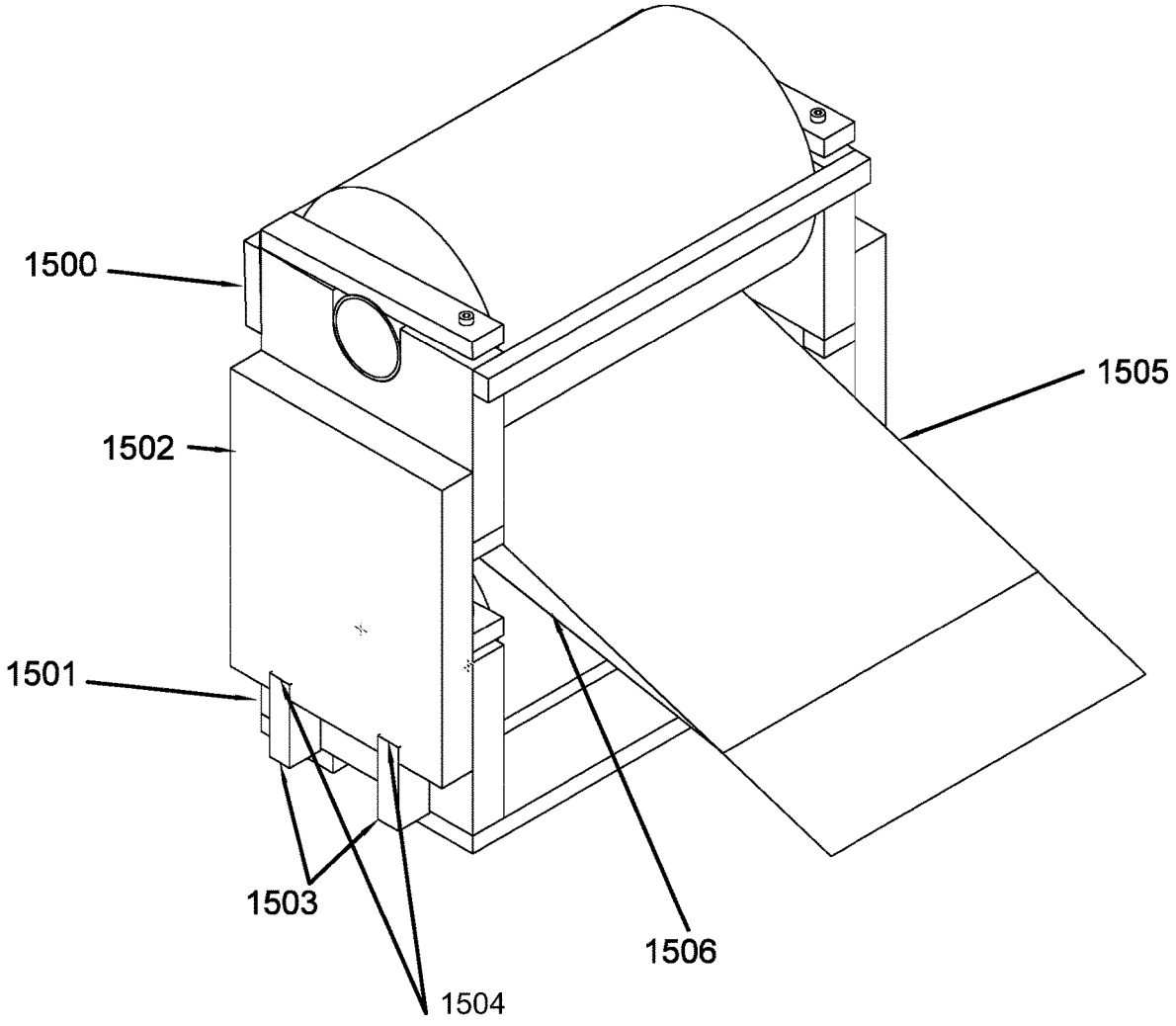
FIG. 15 is a perspective view of double layer system.

A double layer expander is created from two single layer expanders with the addition of two types of exteriorly attached wood slats. The upper wood slats are attached to the yokes and form the attachment to the lower single layer expander. Each upper wood slat has two square cut out areas that interlock to two bottom wood exteriorly positioned wood slats. This system can dispense any type of expanded slit sheet material. The preferred embodiment is to utilize the dual-layer interlocking expanded slit sheet system described in patent pending application Ser. No. 15/001,168 the disclosure of which is incorporated by reference herein, as though recited in full. When utilizing the interlocking dual layer system, the preferred embodiment is to feed the lower paper roll upward from the back of the roll and the upper paper roll is to feed backward from the bottom of the roll as shown in FIG. 15.

Manual Expander Releasable Design

The new manual expander art provides the same service as disclosed in provisional patent applications 62/292,727 and 62/425,200. The disclosures of US provisional patent applications 62/292,727 and 62/425,200 are incorporated herein by reference in their entirety, as if they were recited in full as part of the description of the present invention. The new art provides several improvements to provide a greater ease of use and dispensing of the expanded slit sheet material.

The purpose of the present invention is to enable the user to quickly feed the slit sheet material in its unexpanded form, using a mechanism that releases the paper tension so that the paper can feed freely and then resume the proper preset tension to continue wrapping. This approach enables the user to wrap more quickly when, for example, a sharp-edged item being packed would normally tear the expanded slit sheet. In this case, the user is able to get past this sharp edge by eliminating the tension, and continue wrapping by changing the direction of the item so that the wrap can continue perpendicularly and around the sharp edge in a bisecting direction. Another reason for the instant art is for grabbing the paper when it is close to the paper rolls. Again, with preset tension, the user would have to grab the paper with two hands to apply even pulling pressure across the width of the expanded slit sheet so that it will not tear. With the system in a releasable position the user can still hold the item being packed and grab the expanded slit sheet with one hand to pull the material. Once a long enough section is pulled the user returns to the preset position and continues wrapping. The releasable tension is started and terminated through the use of a foot pedal 102 as shown in FIG. 1. The foot pedal, when pressed, closes the electrical contacts that apply electrical power to the actuators 103 in FIG. 1. During the pressing of the foot pedal the user can pull the expanded slit sheet material freely. When no longer needed, the foot pedal is released and the electrical current is terminated which retracts the linear actuators to the off position, thereby returning the system to the preset condition.

Figure 2:
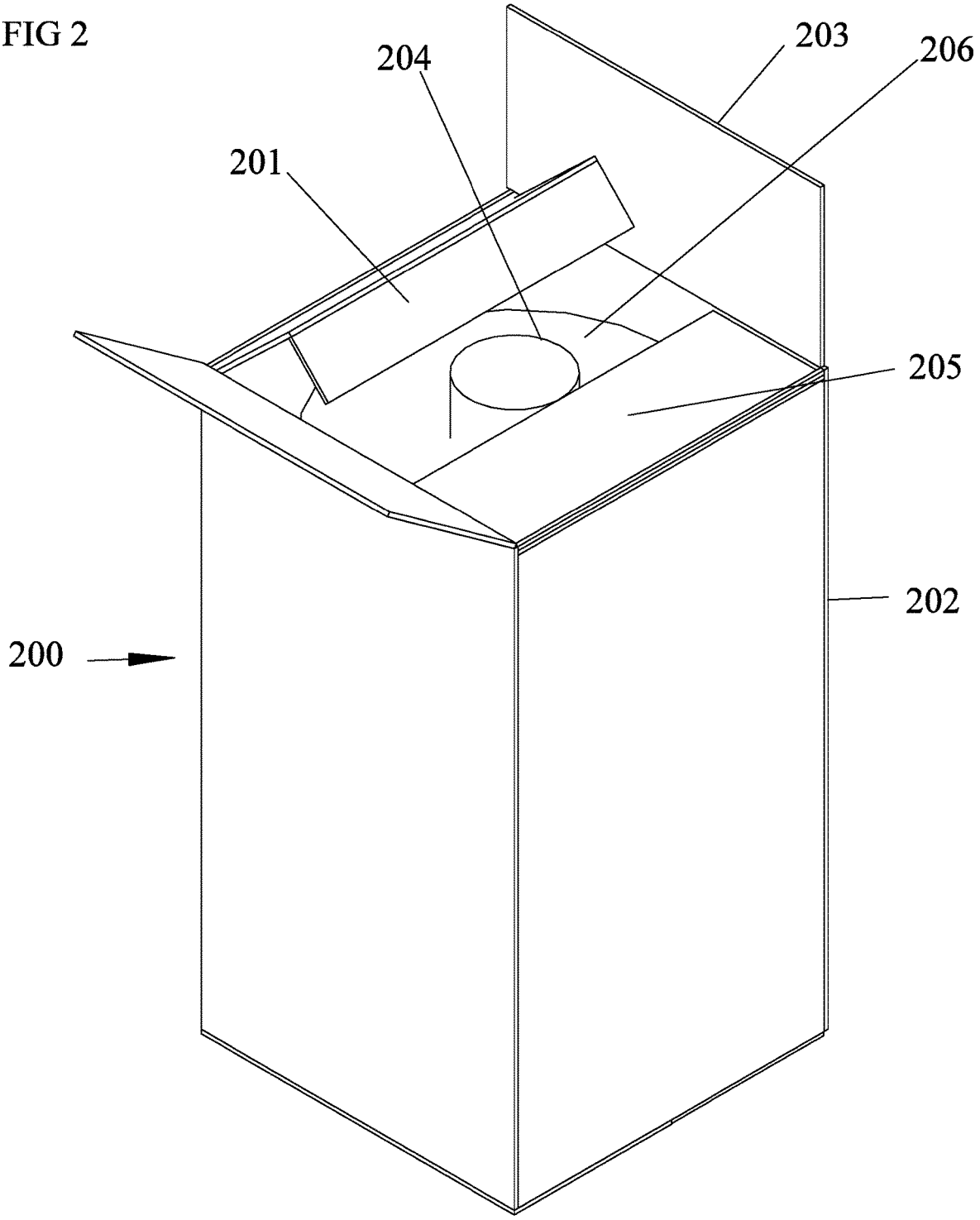
FIG. 2 is a perspective view of the corrugated box supporting the roll and paper core.

The improvement over the system of prior provisional art 62/425,200 provides for an assisted mechanism that is shown in the embodiment with the preferred design in FIGS. 1 and 2 using electrical power and linear actuators. The releasable tension can also be created using a mechanical system of a foot pedal connected to a cabling system and the like that lifts the roll holders in 1701 and 1706 in FIG. 17 upward from paper cores 1711 and 1712. The concept, through the use of screws and springs, is to apply pressure to the paper core 1711 and 1712 to a perfect preset tension and, when needed, to release this tension by separating the roll holder from the paper core as shown in open area 1705.

Figure 18:
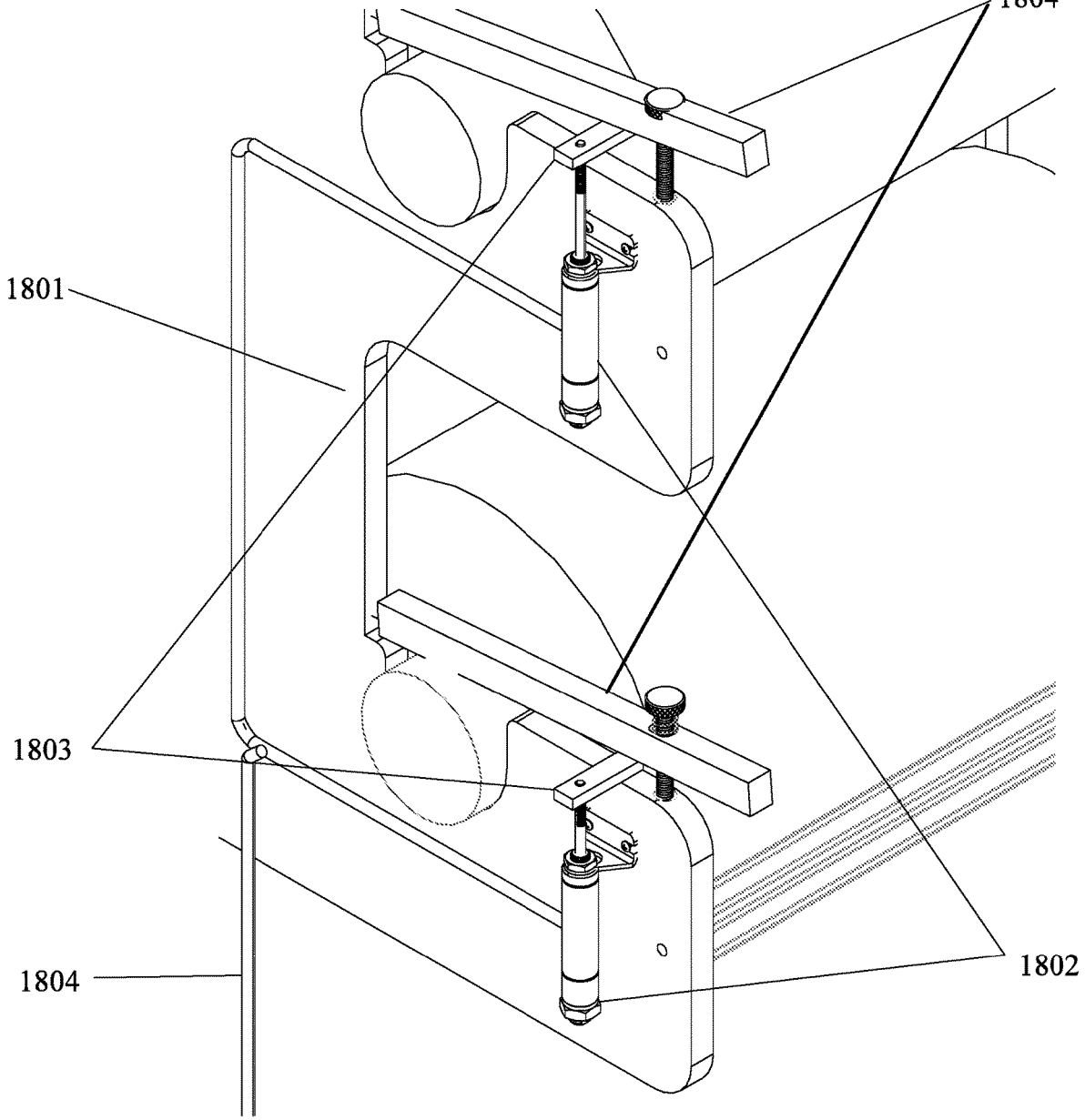
FIG. 18 is a perspective view of a side attached releasable mechanism in the open and closed position

Another design to create releasable tension is to place the linear actuators, as shown in FIG. 18, on the side of the yoke that lifts the roll holder from the side and behind the thumbscrew. The lifting mechanism requires an additional part as shown in FIG. 18 1803 that attaches to the linear actuator that applies pressure under the roll holder as shown. FIG. 18 also shows another preferred embodiment using a pneumatic air cylinder that acts identically to the electric linear actuator but using compressed air.

Still another releasable design provides a pulling tension though the cabling or pneumatic or electric actuating system whereby the lifting mechanism of FIG. 18 1803 is pulled upward.

Figure 17:
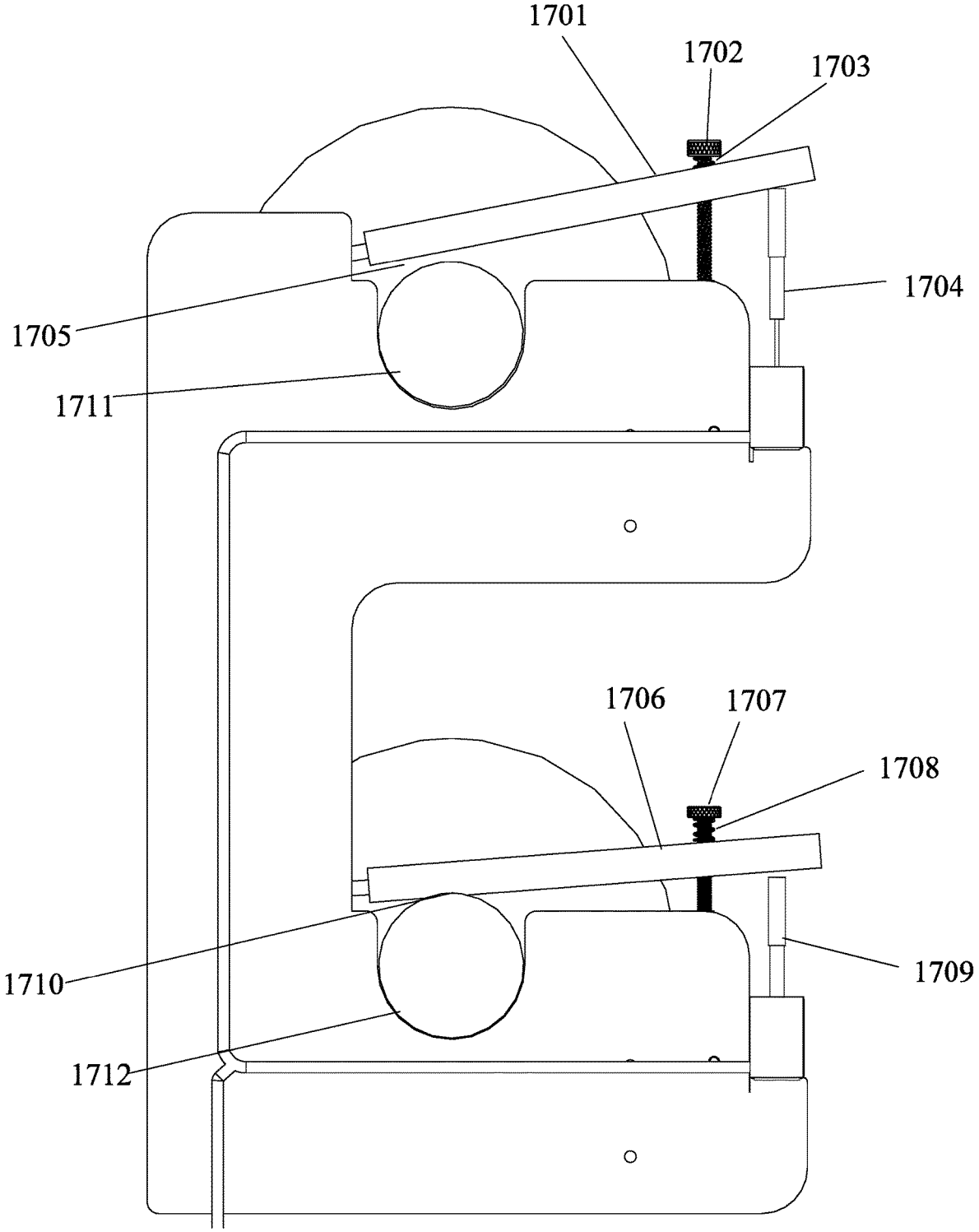
FIG. 17 is a side view of the two stages of the front attached releasable mechanism in the open and closed position.

Normally the releasable system and the preset system are used simultaneously for both upper and lower rolls to utilize both layers. To describe the process efficiently, however, the lower roll holder in FIG. 17 is shown in the closed preset position with closed space 1710 while the upper roll holder 1701 is in the releasable position with open space 1705. The first step in preparing for the use of the single or double layer expanding system is to preset the tension of the roll holders 1701 and 1706 using thumbscrews 1702 and 1707. The thumbscrews apply pressure to springs 1703 and 208 that then apply pressure to roll holder 1701 and 1706. Once the pressure is adjusted properly it enables the slit sheet to expand and feed simultaneously.

Focusing on the upper roll in FIG. 17, the instant art uses the linear actuator 1704 to move upward and apply an upward pressure to the roll holder 1701 that overcomes the spring pressure and thereby compresses the spring 1703, as shown, and moves the upper roll holder 1701 away from paper core 1713 as shown with open area 1706.

Focusing now on the lower roll holder, depicting when the releasable tension is no longer necessary, the linear actuator is switched off by releasing the foot pedal that returns the linear actuator to the retracted position, and thus returning the expander to the preset condition as shown with the contact of the roll holder 1706 with paper core 1710.

DESCRIPTION OF THE DRAWINGS

FIG. 1 is a flat unassembled view of the corrugated box where 100 represents the four panels that make up the body of the box, and 103 is the glue tab that is used for assembly. 101 and 102 make up the entire rotatable panels that are on each end of the body of the box where 102 becomes the Sub Panel that will fold downward against the paper roll when assembled.

FIG. 2 is a perspective view of the box 200 where the paper roll 206 is wrapped around the paper core 204 and is in position to receive sub-panel flap 201 as shown. Rotatable-flap 205 is in a perpendicular position as shown on the right side of paper core 204 and also has a rotatable sub-panel that cannot be seen but will be adjacent to rotatable sub-panel 201 when rotatable sub-panel 201 is in position for shipping.

Figure 3:
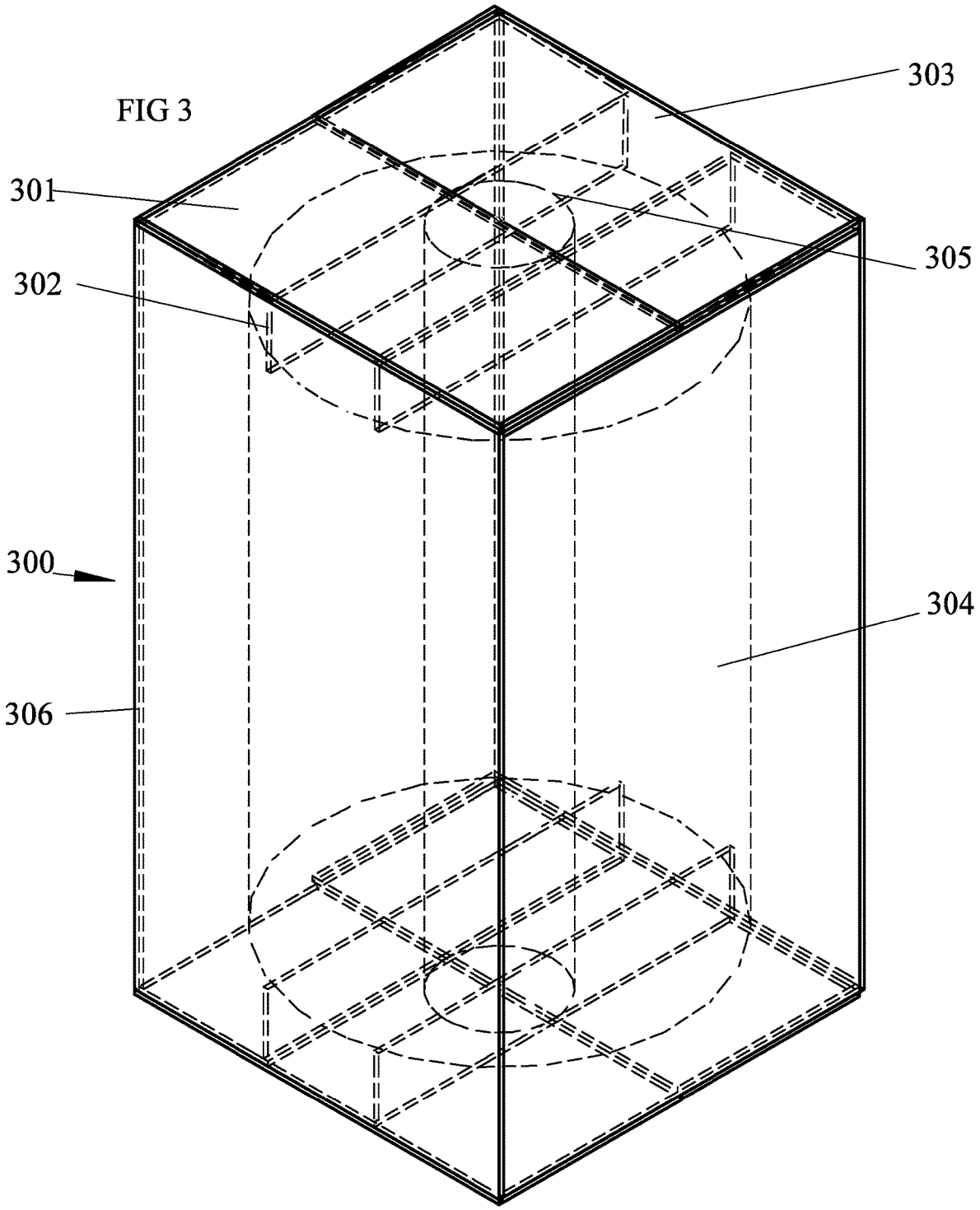
FIG. 3 is a perspective view of the corrugated box in its closed and ready to ship position.

FIG. 3 is a perspective view of box 300 that is ready to ship with rotatable panels 301 and 303 perpendicular to the box sides 306 and rotatable sub-panels 302 are parallel to the box sides 306 and pressing against paper roll 304 and Paper Core 305.

Figure 4:
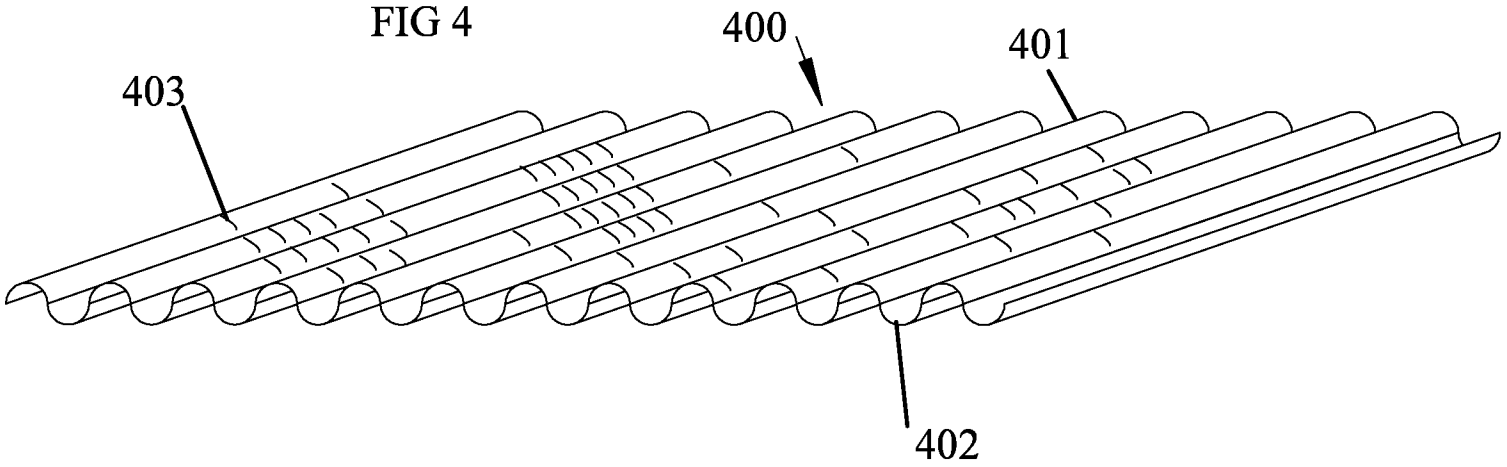
FIG. 4 is a perspective view of the virgin unexpanded slit material.

FIG. 4 is a perspective view of the virgin unexpanded slit sheet material 400 made of paper where 403 is the rows of slits. The regions making up the upper 401 and lower 402 undulations of the sine wave formed when using virgin paper runs perpendicular to the slit direction 403.

Figure 5:
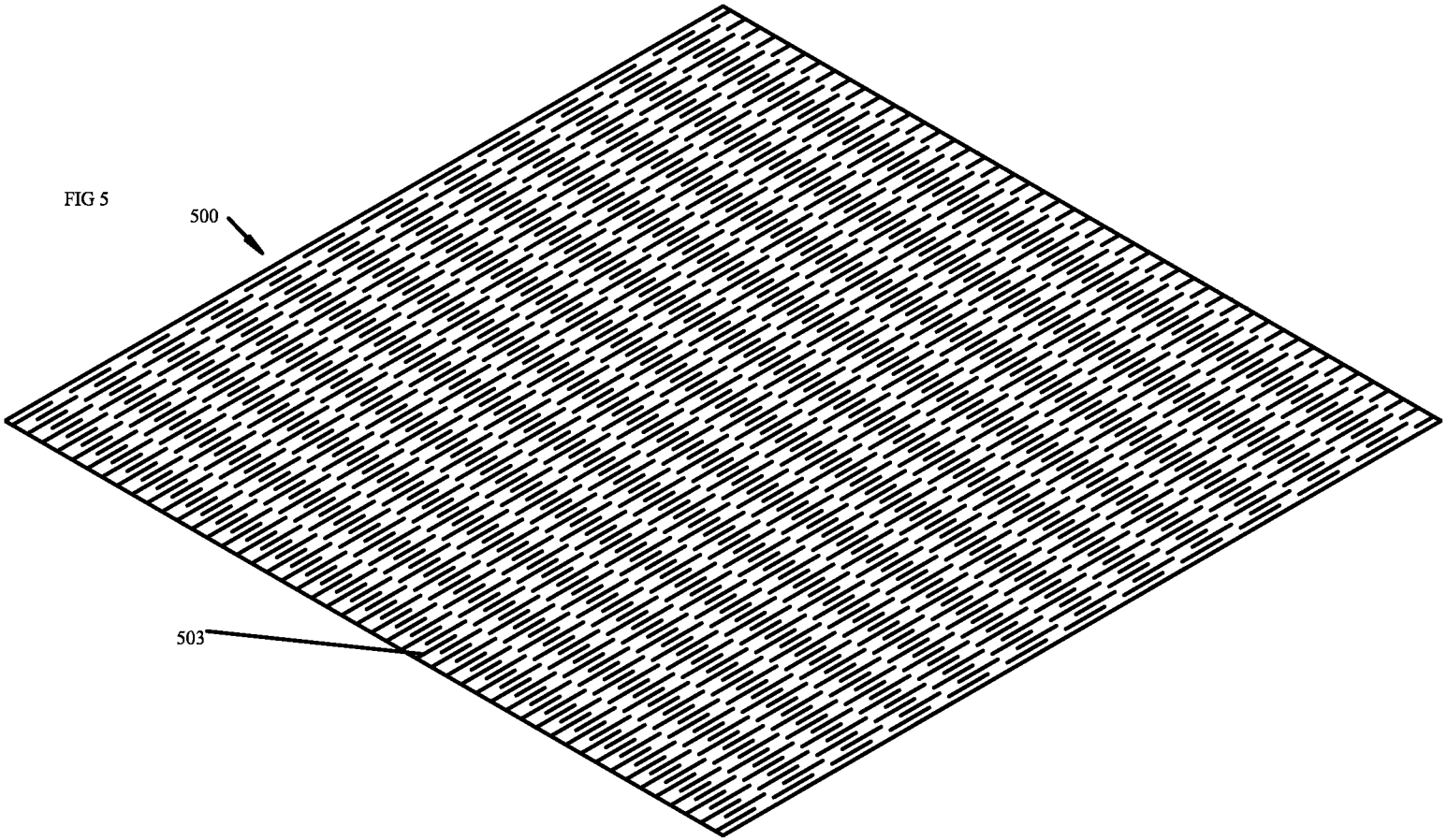
FIG. 5 is a perspective view of a recycled unexpanded slit material.

FIG. 5 is a perspective view of the recycled unexpanded slit sheet material 500 made of paper where 503 is the rows of slits. The paper after manufacturing is virtually flat.

Figure 6:
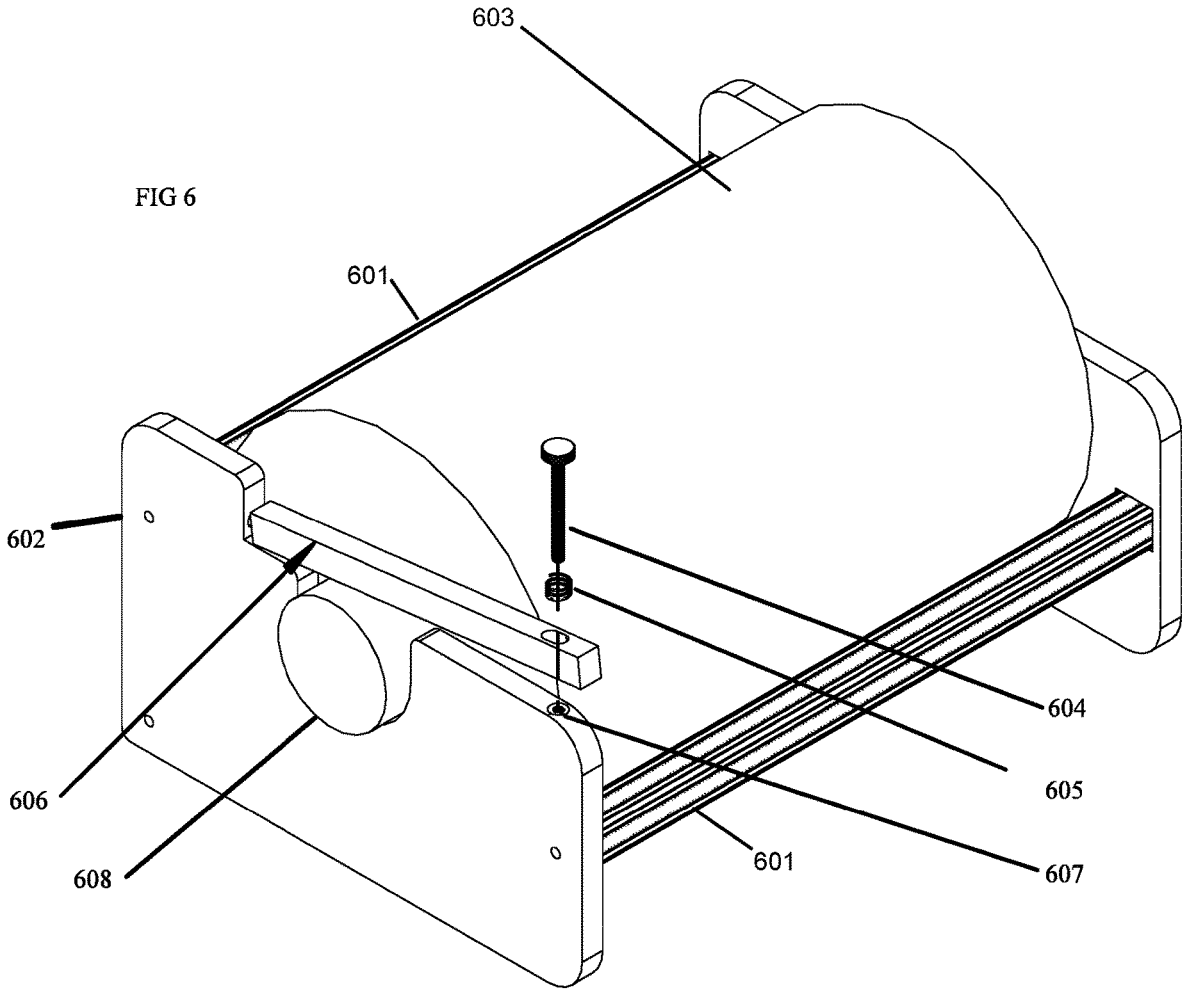
FIG. 6 is a perspective view of the single layer expansion system.

FIG. 6 is the single expansion apparatus made up of two yokes 602 and preferably at least three cross members 601. Paper core 608 sits in the yoke 602 and holds the paper roll 603 that is wound around it. A threaded insert 607 receives thumb screw 604 first through the spring 605 and then through roll holder 606 and into the metal threaded insert 607 to enable the roll holder to apply downward pressure to the paper core 608.

FIG. 7 is a perspective view of the unassembled manual expander where yokes 700 accept cross members 706 into recessed areas on the yoke 701 and are secured using screws 711 through the yoke hole 702 into cross member 706. Roll holder 707 accesses yoke hole 712 to secure its position on the rear of the yoke while thumb screw 710 passes through spring 709 and through roll holder 707 though hole 708 into metal threaded fixture 704.

Figure 8:
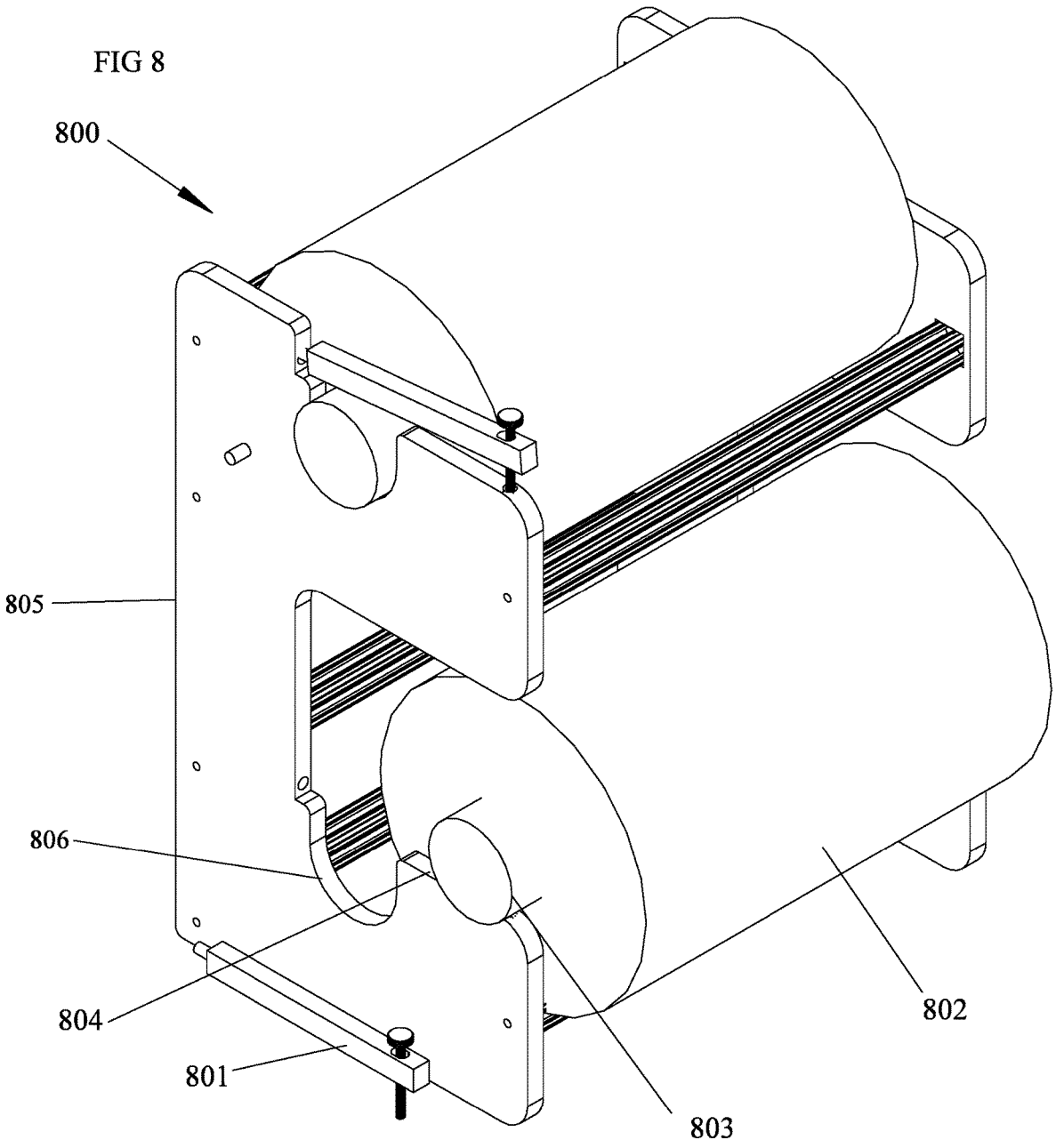
FIG. 8 is a perspective view of the double layer expansion system.

FIG. 8 is a perspective paper loading view of double manual expander 800 that shows lower roll holder assembly and thumb screw 801 removed and resting next to the double manual expander 800. Paper roll 802 connected to paper core 803 is being guided towards yoke opening 804 where paper core 803 will rest.

Figure 9:
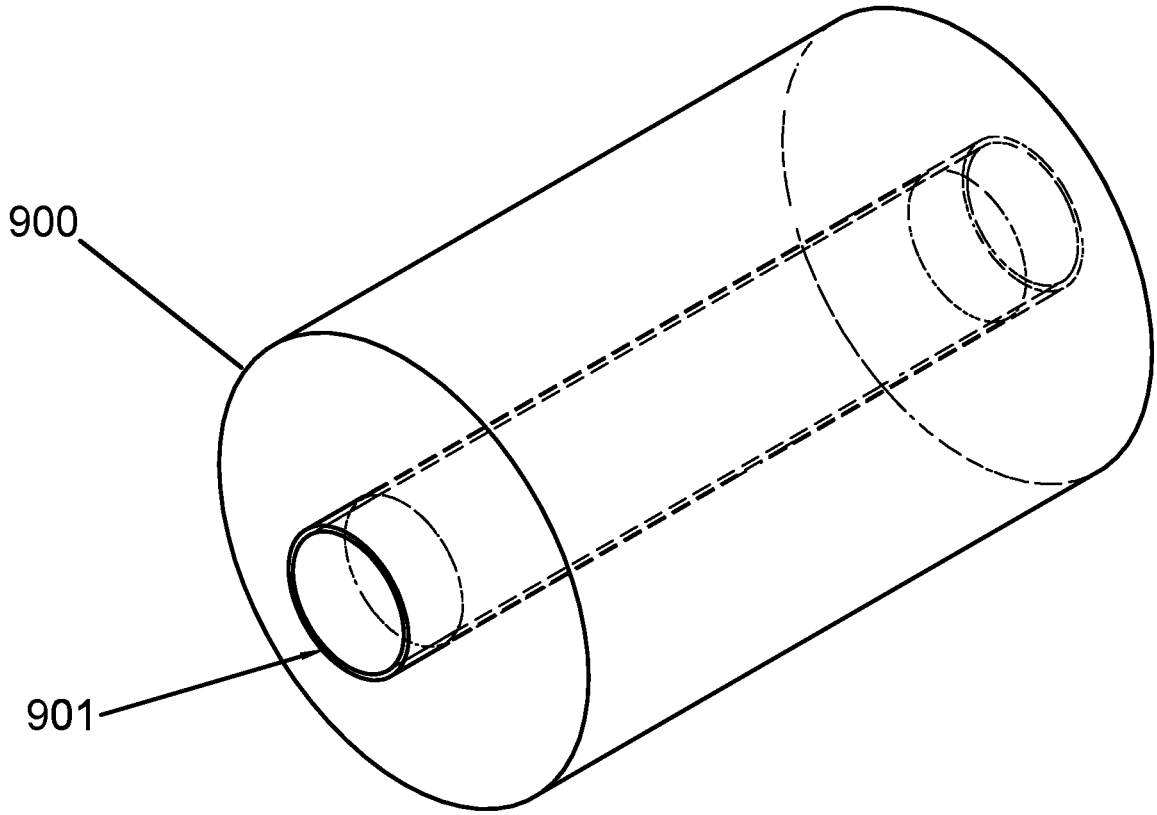
FIG. 9 is a perspective view of the unexpanded slit sheet roll with the wider paper core.

FIG. 9 Is the perspective view of the paper roll such that 900 is the unexpanded slit sheet paper wound around the wider paper core 901.

Figure 10:
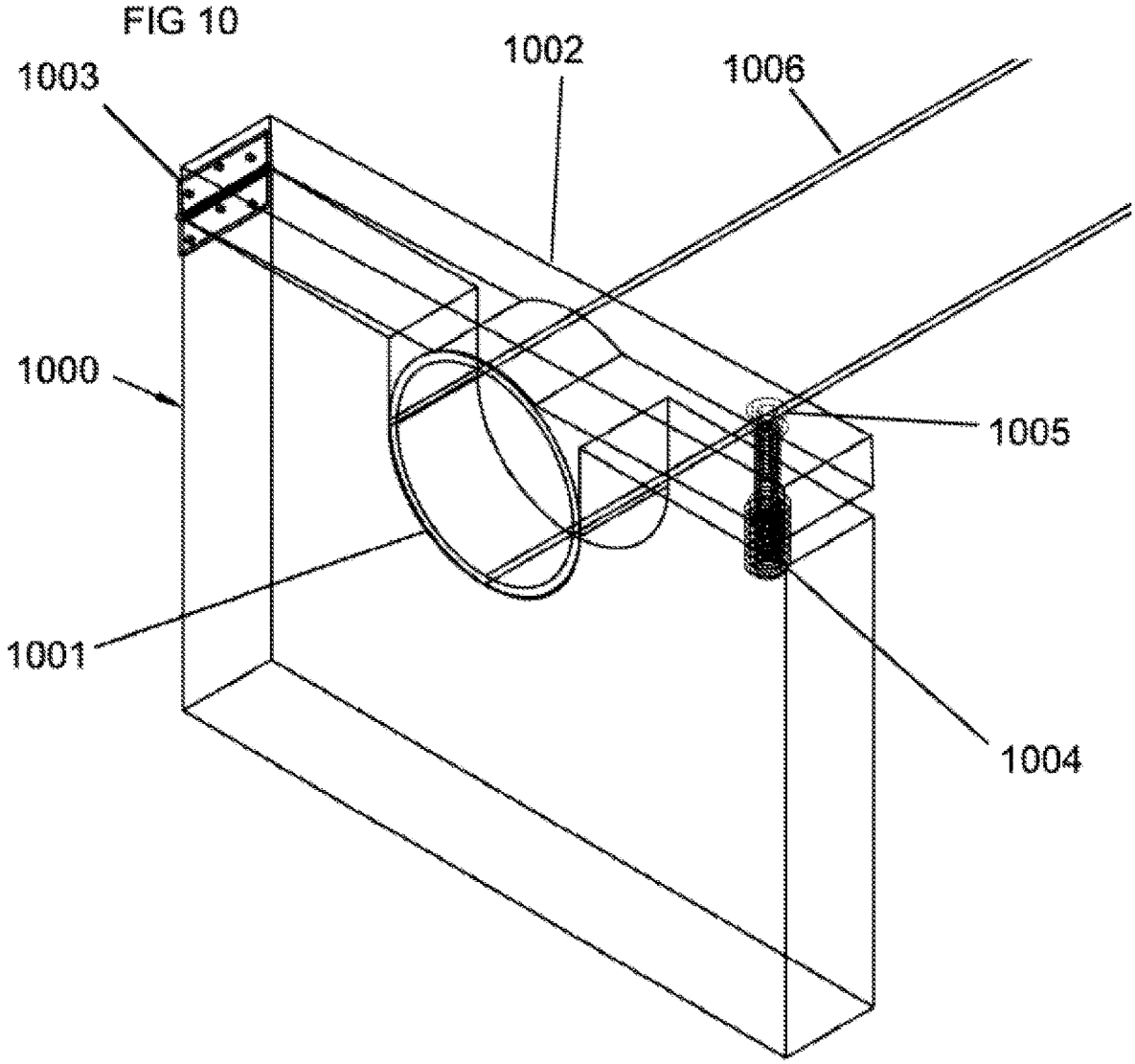
FIG. 10 is a detailed view of the yoke that houses the paper roll and pressure arm.

FIG. 10 is the detailed assembly of the yoke 1000 where the yoke opening 1001 receives the paper core 1006. Pressure arm 1002 as shown as a radial cutout in the center but can be made flat is attached to hinge 1003 for opening and closing. When the paper roll 1006 is in place, the threaded wood insert receives bolt 1005 by passing through a hole of pressure arm 1002 and threading into wood threaded insert 1004 to increase the pressure against the paper core 1006. This creates the downward pressure against the paper core 1006 using the pressure arm 1002 in combination with the hinge 203 and the threaded bolt 1005.

Figure 11:
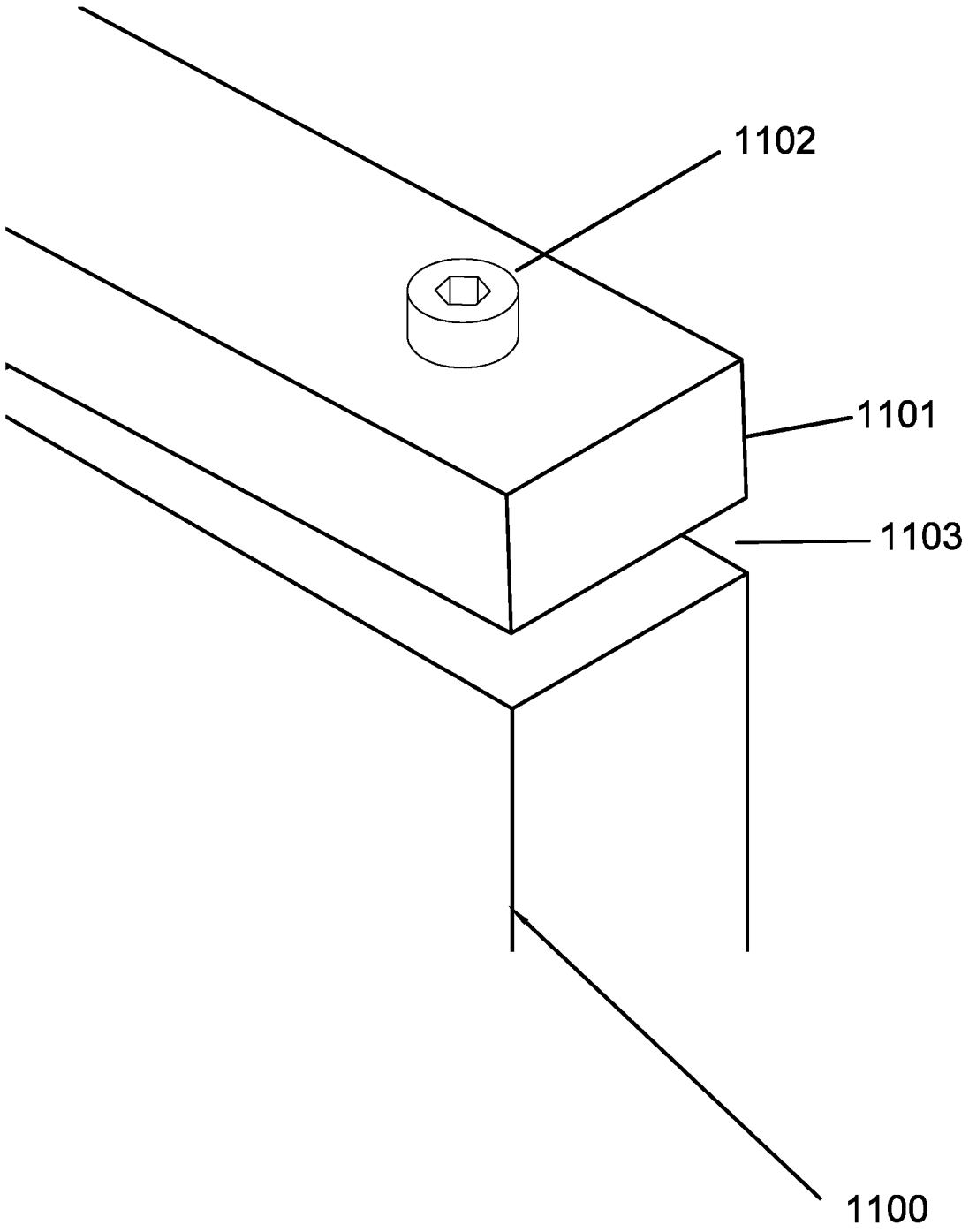
FIG. 11 is a perspective view of an empty manual expander being loaded.

FIG. 11 is a perspective view of the pressure arm assembly where roll holder 1101 is being held in place by threaded bolt 1102. Open space 1103 is created due to the pressure against the paper core of FIG. 10 1003 which elevates the threaded bolt end 1102 of roll holder 1101.

Figure 12:
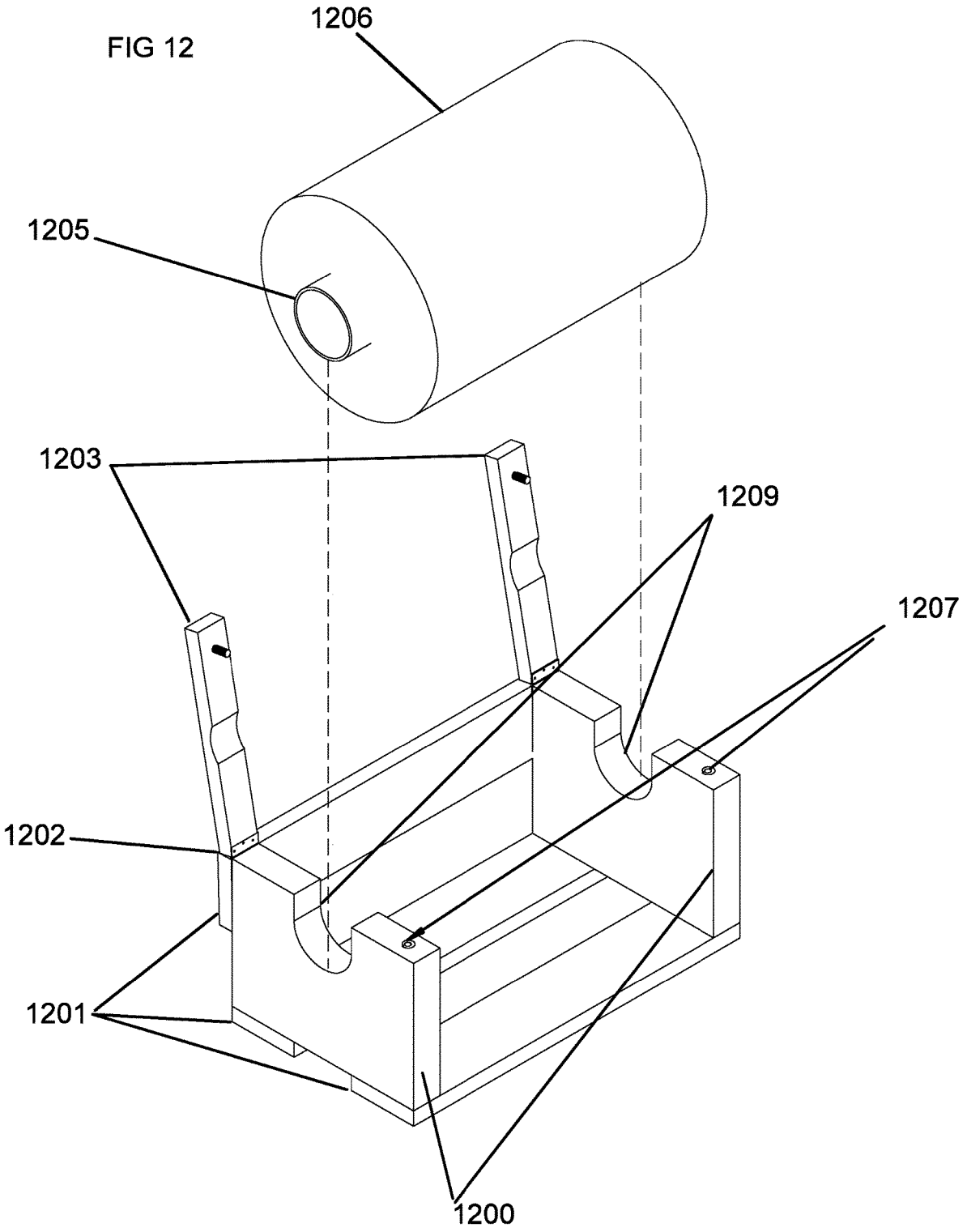
FIG. 12 is a detailed view of the pressure arm within the yoke.

FIG. 12 is the perspective view of the single layer expander paper made of its component parts. Yokes 1200 are attached to wood slats 1201 with pressure arm assemblies 1203 attached to yokes by hinges 1202 placed in the upward and open position. Paper roll assembly 1206 and 1205 are lowered into the yokes 1200 with paper core 1205 making contact in yoke openings 1209.

Figure 13:
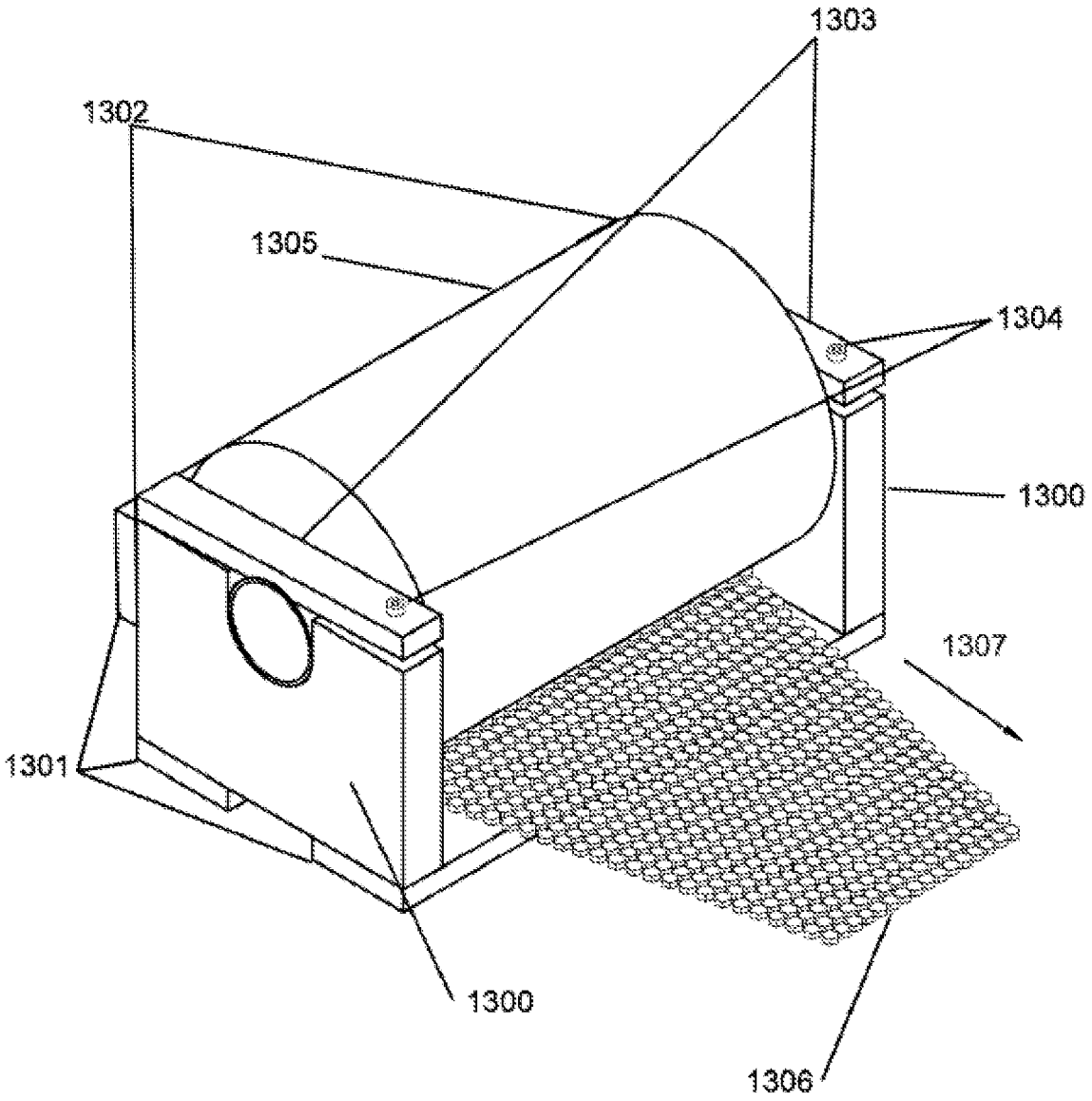
FIG. 13 is a perspective view of the complete system.

FIG. 13 is a perspective view of the single layer expander assembly. Yokes 1300 are attached to side boards 1301 making up the box shape. Paper roll 1305 is placed on the yokes 1300 and is held in place with the pressure arms 1303. Hinges 1302 and threaded bolt 1304 complete the pressure arm system to apply pressure to the paper roll 1305. The stretching-feeding process creates the expanded slit sheet paper 1306 in the direction of 1307 as shown.

FIG. 14 is an exploded perspective view of the double-layer expander where two single layer expanders 1400 are placed vertically so that both paper rolls 1403 will unwind and provide two expanding layers as shown in FIG. 15. To create the double-layer expander, exterior part 1401 is attached to the upper single layer expander and exterior parts 1402 are attached to the lower single layer expander on each side. As the upper assembly 1401 is lowered to 1402 the locking cavities 1403 secure the upper single layer expander to the lower single layer expander.

FIG. 15 is a perspective view of the double layer expander set to stretch and feed paper where single layer expanders 1500 and 1501 are attached to each other with wood slats 1502 and 1503 and interlock to each other at the point of contact of 1504. Lower paper 1506 is fed as a continuous sheet and is combined with continuous upper paper continuous sheet 1505.

FIG. 16 is a perspective view of the double roll power assisted manual expanding system 1600. Upper and lower paper roll 1604 sits in left and right yokes 1606. Roll holder 1605 applies pressure to paper core 1607 to increase friction. Roll holder 1605 receives pressure from thumbscrew and springs 1608 to create the perfect preset condition. Actuators 1603 counteract the preset position by pushing up on roll holders 1605, thereby reducing or eliminating pressure on paper cores 1607. The actuators 1603 are powered by power supply 1601 by stepping on foot pedal 1602 that closes the circuit and sends electricity through power lines 1606 to the linear actuators 1603. When the foot pedal is released the circuit opens and the actuator rods 1603 return to their resting position as shown in more detail in FIG. 17.

FIG. 17 is a side view of the double roll power assisted manual expanding system where 1701 and 1706 are the roll holders that place a downward pressure on paper cores 1711 and 1712 from the force applied with thumbscrews 1702 and 1707 and through the spring 1703 and 1708 respectively. The pressure is releasable using linear actuators 1704 and 1709.

FIG. 18 is a perspective view of the left yoke 1801 with the attached linear actuators 1802 mounted to the side of the yoke with a metal lifting part 1803 attached to the linear actuator and used to fit under the roll holder 1804. Linear actuators 1802 are pneumatically pressurized using air tubes 1804 that provide pressure to the metal lifting part 1803 lifting the roll holder 1804.

The use of the terms "a" and "an" and "the" and similar references in the context of this disclosure (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., such as, preferred, preferably) provided herein, is intended merely to further illustrate the content of the disclosure and does not pose a limitation on the scope of the claims. No language in the specification should be construed as indicating any non-claimed element as essential to the practice of the present disclosure.

Multiple embodiments are described herein, including the best mode known to the inventor for practicing the claimed invention. Of these, variations of the disclosed embodiments will become apparent to those of ordinary skill in the art upon reading the foregoing disclosure. The inventor expects skilled artisans to employ such variations as appropriate (e.g., altering or combining features or embodiments), and the inventor intends for the invention to be practiced otherwise than as specifically described herein.

Accordingly, this invention includes all modifications and equivalents of the subject matter recited in the claims appended hereto as permitted by applicable law. Moreover, any combination of the above described elements in all possible variations thereof is encompassed by the invention unless otherwise indicated herein or otherwise clearly contradicted by context.

The use of individual numerical values are stated as approximations as though the values were preceded by the word "about," "substantially," or "approximately." Similarly, the numerical values in the various ranges specified in this application, unless expressly indicated otherwise, are stated as approximations as though the minimum and maximum values within the stated ranges were both preceded by the word "about", "substantially", or "approximately." In this manner, variations above and below the stated ranges can be used to achieve substantially the same results as values within the ranges. As used herein, the terms "about", "substantially", and "approximately" when referring to a numerical value shall have their plain and ordinary meanings to a person of ordinary skill in the art to which the disclosed subject matter is most closely related or the art relevant to the range or element at issue. The amount of broadening from the strict numerical boundary depends upon many factors. For example, some of the factors which can be considered include the criticality of the element and/or the effect a given amount of variation will have on the performance of the claimed subject matter, as well as other considerations known to those of skill in the art. As used herein, the use of differing amounts of significant digits for different numerical values is not meant to limit how the use of the words "about," "substantially," or "approximately" will serve to broaden a particular numerical value or range. Thus, as a general matter, "about," "substantially," or "approximately" broaden the numerical value. Also, the disclosure of ranges is intended as a continuous range including every value between the minimum and maximum values plus the broadening of the range afforded by the use of the term "about," "substantially," or "approximately." Thus, recitation of ranges of values herein are merely intended to serve as a shorthand method of referring individually to each separate value falling within the range, unless otherwise indicated herein, and each separate value is incorporated into the specification as if it were individually recited herein. To the extent that determining a given amount of variation of some the factors such as the criticality of the slit patterns, paper width differential pre- and post-expansion, paper weights and type, as well as other considerations known to those of ordinary skill in the art to which the disclosed subject matter is most closely related or the art relevant to the range or element at issue will have on the performance of the claimed subject matter, is not considered to be within the ability of one of ordinary skill in the art, or is not explicitly stated in the claims, then the terms "about," "substantially," and "approximately," should be understood to mean the numerical or other value, plus or minus 15%.

It is to be understood that any ranges, ratios, and ranges of ratios that can be formed by, or derived from, any of the data disclosed herein represent further embodiments of the present disclosure and are included as part of the disclosure as though they were explicitly set forth. This includes ranges that can be formed that do or do not include a finite upper and/or lower boundary. Accordingly, a person of ordinary skill in the art most closely related to a particular range, ratio or range of ratios will appreciate that such values are unambiguously derivable from the data presented herein.

The invention claimed is:

1. An expander device for manually expanding slit sheet paper, comprising:

a) a roll of slit sheet paper having rows of straight slits extending parallel to an axis of the roll, said slit sheet paper being manually expandable across an entire width of the roll of slit sheet paper upon applying a manual pulling force to a distal end of said slit sheet paper in a direction perpendicular to the axis of the roll such that the entire width of the roll of slit sheet paper expands in the direction perpendicular to the axis of the roll;

b) a support that rotatably suspends the roll of slit sheet paper;

c) a pressure mechanism that inhibits rotation of said roll of slit sheet paper with respect to said support, including:

a first member connected to said roll of slit sheet paper that rotates with said roll of slit sheet paper;

a pressing member that exerts frictional pressure against said first member connected to said roll of slit sheet paper to inhibit rotation of said roll of slit sheet paper with respect to said support;

a spring formed from an elongated spiral member arranged to exert a spring force against said pressing member contributing to said frictional pressure against said first member connected to said roll of slit sheet paper; and a movable member that is movable to exert a pressure against said spring and cause said elongated spiral member to bend to adjust the spring force exerted by the spring against said pressing member;

d) whereby the slit sheet paper can be manually pulled and expanded from the roll of slit sheet paper upon applying a manual pulling force, in a direction perpendicular to the axis of the roll along a plain of the slit sheet paper to a periphery of the roll, to the distal end of said slit sheet paper sufficient to unwind the roll of slit sheet paper by moving said movable member to exert a pressure against said spring, such that said spring then exerts a spring force against said pressing member, such that said pressing member then exerts frictional pressure against said first member.

2. The expander device of claim 1, wherein said first member connected to said roll of slit sheet paper includes a rod or tube via which said roll of slit sheet paper is supported.

3. The expander device of claim 2, wherein said rod or tube is a paper core member.

4. The expander device of claim 3, wherein said paper core member extends entirely across a length of said roll of slit sheet paper.

5. The expander device of claim 1, wherein said first member connected to said roll of slit sheet paper includes a rod or tube that extends within an interior of the roll of slit sheet paper.

6. The expander device of claim 1, wherein said first member connected to said roll of slit sheet paper includes a rod or tube that protrudes from an interior of the roll of slit sheet paper.

7. The expander device of claim 1, wherein said first member connected to said roll of slit sheet paper directly contacts said roll of slit sheet paper.

8. The expander device of claim 1, wherein said pressing member directly contacts said first member connected to said roll of slit sheet paper.

9. The expander device of claim 1, wherein said spring directly contacts said pressing member.

10. The expander device of claim 1, wherein said movable member directly contacts said spring.

11. The expander device of claim 1, wherein said movable member includes threads to adjust the spring force applied upon rotation of the movable member.

12. The expander device of claim 1, wherein rotation of said movable member causes rotation of a threaded shaft, wherein rotation of the threaded shaft in a first direction compresses the spring against said pressing member and increases frictional pressure against said first member connected to said roll of slit sheet paper and rotation of the threaded shaft in a second direction decreases the frictional pressure against said first member connected to said roll of slit sheet paper.

13. The expander device of claim 12, wherein said spring extends around said threaded shaft.

14. The expander device of claim 1, wherein said roll of slit sheet paper is made with an elongated sheet of slit sheet paper wound into a roll, wherein said rows of straight slits extending parallel to the axis of the roll extend perpendicular to lateral sides of said elongated sheet of slit sheet paper and include slits extending to each of said lateral sides of said elongated sheet of slit sheet paper.

15. The expander device of claim 1, where said first pressing member is a screw or bolt.

16. The expander device of claim 1, where said movable member is an arm or block.

17. A pressure mechanism for inhibiting rotation of a roll of slit sheet paper that is rotatably suspended in a support of an expander device to regulate force required to manually expand the slit sheet paper, comprising:

a first member that connects to the roll of slit sheet paper to rotate with said roll of slit sheet paper;

a pressing member that exerts frictional pressure against said first member that connects to the roll of slit sheet paper to inhibit rotation of the roll of slit sheet paper;

a spring formed from an elongated spiral member arranged to exert a spring force against said pressing member to contribute to said frictional pressure against said first member that connects to the roll of slit sheet paper; and a movable member that is movable to exert a pressure against said spring to adjust the spring force exerted by the spring against said pressing member, whereby a slit sheet paper having an array of straight slits extending parallel to an axis of the roll can be manually pulled and expanded from a roll of slit sheet paper that is rotatably suspended in a support of an expander device upon applying a manual pulling force to a distal end of said slit sheet paper in a direction perpendicular to an axis of the roll core along a plain of the slit sheet paper to a periphery of said roll sufficient to overcome the frictional pressure exerted by the pressing member to unwind the roll of slit sheet paper by moving said movable member to exert a pressure against said spring, such that said spring then exerts a spring force against said pressing member, such that said pressing member then exerts frictional pressure against said first member.

18. In combination:

a) the pressure mechanism of claim 17; and b) a roll of slit sheet paper rotatably suspended in a support of an expander device, said roll of slit sheet paper having an array of straight slits extending parallel to an axis of the roll, said slit sheet paper being manually expandable across an entire width of the roll of slit sheet paper upon applying a manual pulling force to a distal end of said slit sheet paper in a direction perpendicular to the axis of the roll such that the entire width of the roll of slit sheet paper expands in the direction perpendicular to the axis of the roll;

said pressure mechanism inhibiting rotation of said roll of slit sheet paper that is rotatably suspended in said support of said expander device.

19. A method comprising:

a) providing the combination of claim 18;

b) applying a manual pulling force to a distal end of said slit sheet paper in a direction perpendicular to the axis of the roll such that the entire width of the roll of slit sheet paper expands in the direction perpendicular to the axis of the roll; and c) regulating the manual pulling force required to manually expand the slit sheet paper by inhibiting rotation of said roll of slit sheet paper that is rotatably suspended in said support of said expander device using said pressure mechanism.

20. The method of claim 19, wherein said applying a manual pulling force to a distal end of said slit sheet paper in a direction perpendicular to the axis of the roll such that the entire width of the roll of slit sheet paper expands in the direction perpendicular to the axis of the roll includes manually pulling the distal end of said slit sheet paper with said slit sheet paper extending freely without contact with the expander device after separating from said roll.

21. A pressure mechanism for inhibiting rotation of a roll of slit sheet paper that is rotatably suspended in a support of an expander device to regulate force required to manually expand the slit sheet paper, comprising:

a first member that connects to the roll of slit sheet paper to rotate with said roll of slit sheet paper;

a spring formed from an elongated spiral member arranged to impart a spring force to exert frictional pressure against said first member that connects to the roll of slit sheet paper to inhibit rotation of the roll of slit sheet paper; and a movable member that is movable to exert a pressure against said spring to adjust the spring force exerted by the spring against said pressing member, whereby a slit sheet paper having an array of straight slits extending parallel to an axis of the roll can be manually pulled and expanded from a roll of slit sheet paper that is rotatably suspended in a support of an expander device upon applying a manual pulling force to a distal end of said slit sheet paper in a direction perpendicular to an axis of the roll core along a plain of the slit sheet paper to a periphery of said roll sufficient to overcome the frictional pressure exerted by the pressing member to unwind the roll of slit sheet paper by moving said movable member to exert a pressure against said spring, such that said spring then exerts a spring force against said pressing member, such that said pressing member then exerts frictional pressure against said first member.

22. The pressure mechanism of claim 21, further including a pressing member that exerts frictional pressure against said first member that connects to the roll of slit sheet paper to inhibit rotation of the roll of slit sheet paper, wherein said spring exerts said spring force against said pressing member to impart said frictional pressure against said first member that connects to the roll of slit sheet paper.

23. In combination:

a) the pressure mechanism of claim 21; and b) a roll of slit sheet paper rotatably suspended in a support of an expander device;

said pressure mechanism inhibiting rotation of said roll of slit sheet paper that is rotatably suspended in said support of said expander device, said roll of slit sheet paper having an array of straight slits extending parallel to an axis of the roll, said slit sheet paper being manually expandable across an entire width of the roll of slit sheet paper upon applying a manual pulling force to a distal end of said slit sheet paper in a direction perpendicular to the axis of the roll such that the entire width of the roll of slit sheet paper expands in the direction perpendicular to the axis of the roll.

24. A method comprising:

a) providing the combination of claim 21;

b) applying a manual pulling force to a distal end of said slit sheet paper in a direction perpendicular to the axis of the roll such that the entire width of the roll of slit sheet paper expands in the direction perpendicular to the axis of the roll; and c) regulating the manual pulling force required to manually expand the slit sheet paper by inhibiting rotation of said roll of slit sheet paper that is rotatably suspended in said support of said expander device using said pressure mechanism.

* * * * *